US008845938B2

(12) United States Patent
Ichikawa et al.

(10) Patent No.: US 8,845,938 B2
(45) Date of Patent: Sep. 30, 2014

(54) POLYACRYLONITRILE FIBER MANUFACTURING METHOD AND CARBON FIBER MANUFACTURING METHOD

(75) Inventors: Tomoko Ichikawa, Iyo-gun (JP); Takashi Ochi, Otsu (JP); Akira Kishiro, Mishima (JP); Yasutaka Kato, Mishima (JP); Takashi Shibata, Iyo-gun (JP); Masafumi Ise, Iyo-gun (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 13/990,540

(22) PCT Filed: Nov. 28, 2011

(86) PCT No.: PCT/JP2011/077306

§ 371 (c)(1), (2), (4) Date: May 30, 2013

(87) PCT Pub. No.: WO2012/073852

PCT Pub. Date: Jun. 7, 2012

(65) Prior Publication Data

US 2013/0264733 A1 Oct. 10, 2013

(30) Foreign Application Priority Data

Nov. 30, 2010 (JP) ..... 2010-266432
Nov. 30, 2010 (JP) ..... 2010-266433
Nov. 30, 2010 (JP) ..... 2010-266434

(51) Int. Cl.

| | |
|---|---|
| ***D02J 1/22*** | (2006.01) |
| ***D01D 10/00*** | (2006.01) |
| ***D01D 5/16*** | (2006.01) |
| ***D01F 6/18*** | (2006.01) |
| ***D01F 9/22*** | (2006.01) |
| ***D01D 10/02*** | (2006.01) |

(52) U.S. Cl.

CPC ..... *D01D 10/00* (2013.01); *D02J 1/228* (2013.01); *D01D 5/16* (2013.01); *D01F 6/18* (2013.01); *D01F 9/22* (2013.01); *D01D 10/02* (2013.01)

USPC ..... 264/29.2; 264/182; 264/206; 264/210.7; 264/210.8; 264/211.15; 264/211.17; 423/447.1

(58) Field of Classification Search

USPC ..... 264/29.2, 182, 206, 210.7, 210.8, 264/211.15, 211.17; 423/447.1

See application file for complete search history.

(56) References Cited

U.S. PATENT DOCUMENTS 2,900,221 A * 8/1959 William Grebby John et al. ..... 264/182
3,001,236 A 9/1961 Maier et al.

(Continued)

FOREIGN PATENT DOCUMENTS

EP 0 329 128 8/1989
EP 1 130 140 9/2001

(Continued)

OTHER PUBLICATIONS

Extended European Search Report dated May 14, 2014 for corresponding European Application No. 11845614.4.

*Primary Examiner* — Leo B Tentoni
(74) *Attorney, Agent, or Firm* — DLA Piper LLP (US)

(57) ABSTRACT

A method of manufacturing a polyacrylonitrile fiber includes a spinning process in which a spinning dope including polyacrylonitrile is spun; a first drawing process; a drying process; and a second hot drawing process in this order.

9 Claims, 4 Drawing Sheets

(56) References Cited

U.S. PATENT DOCUMENTS

| | | | | | |
|---|---|---|---|---|---|
| 3,558,761 | A | * | 1/1971 | Tabara et al. | 264/182 |
| 4,389,364 | A | * | 6/1983 | Endo et al. | 264/210.8 X |
| 4,446,206 | A | * | 5/1984 | Fester et al. | 264/210.7 X |
| 4,447,384 | A | * | 5/1984 | Tamura et al. | 264/206 |
| 4,913,869 | A | | 4/1990 | Funk | |
| 4,952,453 | A | | 8/1990 | Uchida | |
| 2010/0003515 | A1 | | 1/2010 | Tanaka et al. | |

FOREIGN PATENT DOCUMENTS

| | | | | | |
|---|---|---|---|---|---|
| EP | 2080775 | A1 | * | 7/2009 | |
| JP | 58-54016 | | | 3/1983 | |
| JP | 61041326 | A | * | 2/1986 | 26/29.2 |
| JP | 63-275718 | | | 11/1988 | |
| JP | 63-275718 | A | | 11/1988 | |
| JP | 04-263613 | | | 9/1992 | |
| JP | 04-263613 | A | | 9/1992 | |
| JP | 5-272005 | | | 10/1993 | |
| JP | 09-078333 | | | 3/1997 | |
| JP | 09-078333 | A | | 3/1997 | |
| JP | 11-081053 | | | 3/1999 | |
| JP | 11-081053 | A | | 3/1999 | |
| JP | 11-200141 | | | 7/1999 | |
| JP | 11-200141 | A | | 7/1999 | |
| JP | 2008-248219 | | | 10/2008 | |
| JP | 2008-248219 | A | | 10/2008 | |
| JP | 2008-308776 | | | 12/2008 | |
| JP | 2008-308776 | A | | 12/2008 | |

* cited by examiner

POLYACRYLONITRILE FIBER MANUFACTURING METHOD AND CARBON FIBER MANUFACTURING METHOD

TECHNICAL FIELD

This disclosure relates to a method of manufacturing a polyacrylonitrile fiber, and a method of manufacturing a carbon fiber using the polyacrylonitrile fiber obtained by the method.

BACKGROUND

As a method for manufacturing a polyacrylonitrile (hereinafter referred to as PAN) fiber which is a carbon fiber precursor, there has been conventionally performed a method in which a spinning dope is formed into a fiber by wet spinning or dry jet spinning, the obtained fiber is subjected to first drawing, drying, and then subjected to second drawing through a steam tube or the like. The first drawing process therein is a drawing process performed subsequent to the spinning process in the above-mentioned series of processes. Since the drawing is usually performed in a bath such as in warm water, it is also called a bath drawing process. The second drawing process means a drawing process which is additionally performed when a yarn is dried once after the first drawing process. Thus, in the spinning of a PAN fiber which is a carbon fiber precursor, drawing is usually performed twice, of which the former is referred to as first drawing and the latter is referred to as second drawing.

For the purpose of reducing the cost of a carbon fiber, it is believed that the spinning speed of a PAN fiber is increased to improve productivity per unit time. Japanese Patent Laid-open Publication No. 2008-248219 discloses that stringiness is dramatically improved by blending a small amount of high molecular weight PAN with normal molecular weight PAN, thereby achieving high-speed spinning.

In the case where steam drawing using a steam tube is performed as the second drawing process, however, there are fears that increase of the spinning speed for the purpose of improving productivity of a PAN fiber leads to increase of steam leakage from the steam tube and the steam tube needs to be lengthened, which may result in increase in cost. In addition, the use of the lengthened steam tube makes it difficult for a yarn to pass through the tube. Therefore, a second drawing method other than steam drawing has been desired for high-speed spinning. One of the solutions to this is hot drawing.

However, hot drawing cannot be expected to provide the effect of plasticizing by steam such as steam drawing so that there arises a problem that the draw ratio cannot be increased. Further, our studies revealed a problem that the high-speed spinning disclosed in JP '219 would make it more difficult to perform drawing at a high draw ratio.

In hot drawing, multistage hot roll (hereinafter referred to as an HR) drawing in which a plurality of HRs are combined has been studied. Each stage, however, provides low draw ratio, thereby making it difficult to improve productivity (Japanese Patent Laid-open Publication No. 11-200141).

On the other hand, Japanese Patent Laid-open Publication No. 09-078333 discloses that in the hot drawing, a yarn is preheated with a hot roll (HR) and the preheated yarn is subjected to HR-HPL drawing (hot plate drawing) in which a hot plate (hereinafter referred to as an HPL) is arranged so that the maximum draw ratio at break is improved. However, since a contact length (HPL length) between the HPL in use and the yarn is 1 m, which is rather long, the yarn is resident on the HPL over a long period of time (approximately 1.2 seconds) and then deformed by drawing, so that the drawing may tend to become unstable. In addition, Japanese Patent Laid-open Publication No. 04-263613 also discloses hot plate drawing in Comparative Example 1, in which the effect of improving the draw ratio by an HPL is also disclosed. The HPL length is so long as 1 m, however, that the drawing tends to become unstable, and thus U %, which is an index of yarn unevenness, of the drawn yarn is increased as compared with the one obtained in normal HR-HR (HR drawing) (Comparative Example 1 in JP '613). Therefore, JP '613 proposes that hot pins are placed between HPLs and the draw ratio is shared with the hot pin portion where the drawing point is easily fixed and the HPL portion, to thereby reduce yarn unevenness. It is preferable that such yarn unevenness is reduced because continuous drawing for a long period of time can induce fuzz or yarn breakage. Although the use of hot pins can improve U %, there still arises a problem that abrasion between the hot pins and the yarn is likely to induce fuzz or yarn breakage.

Although stretchability and stainability can be improved by copolymerizing large amounts of a second component and a third component into PAN like an acrylic fiber for clothing. However, when the resulting product is used as a carbon fiber precursor, components to be lost during an oxidization and carbonization treatment increase. Therefore, not only the yield of carbon fiber decreases, but a defect is likely to generate in the carbon fiber, which may deteriorate mechanical properties in some cases.

It could therefore be helpful to provide a method of manufacturing a polyacrylonitrile fiber which is excellent in productivity with little fuzz and less yarn breakage, together with a sufficient draw ratio obtained even during high-speed hot drawing.

SUMMARY

We thus provide a method of manufacturing the polyacrylonitrile fiber as follows.

A method of manufacturing a polyacrylonitrile fiber including a spinning process in which a spinning dope containing polyacrylonitrile is spun, a first drawing process, a drying process, and a second drawing process in this order, the method including, as the second drawing process, any of the following hot drawing processes (a) to (c):

(a) a process of performing, as the second drawing, hot drawing with a plurality of rolls, at least one of which is a hot roll, in the air setting a yarn temperature from a yarn separation point on the hot roll to a first yarn contact point on the subsequent roll to 130° C. or higher;

(b) a process of performing, as the second drawing, hot drawing with a plurality of rolls, at least one of which is a hot roll, setting a distance from the yarn separation point on the hot roll to the first yarn contact point on the subsequent roll to 20 cm or less; and (c) a process of performing the second drawing in a hot plate drawing zone where a hot plate is placed between two rolls, one of which is a preheating roll arranged forward of the hot plate drawing zone, while the hot plate is positioned so that a start point of contact between the hot plate and a yarn is at a distance of 30 cm or less from the yarn separation point on the preheating roll, and the surface speed of the preheating roll is set to 100 m/min or more.

We also provide a method of manufacturing a carbon fiber, including a process of further subjecting the polyacrylonitrile fiber obtained by the above-mentioned method to carbonization.

According to our method of manufacturing a polyacrylonitrile fiber, not only a conventional problem such that the draw ratio is lowered during high-speed hot drawing can be solved, but also generation of fuzz and yarn breakage can be improved, resulting in improvement in productivity of the polyacrylonitrile fiber. Further, according to our method of manufacturing a carbon fiber, productivity of the carbon fiber can be improved and the cost of the carbon fiber can be reduced.

DESCRIPTION OF REFERENCE SIGNS

Figure 1:
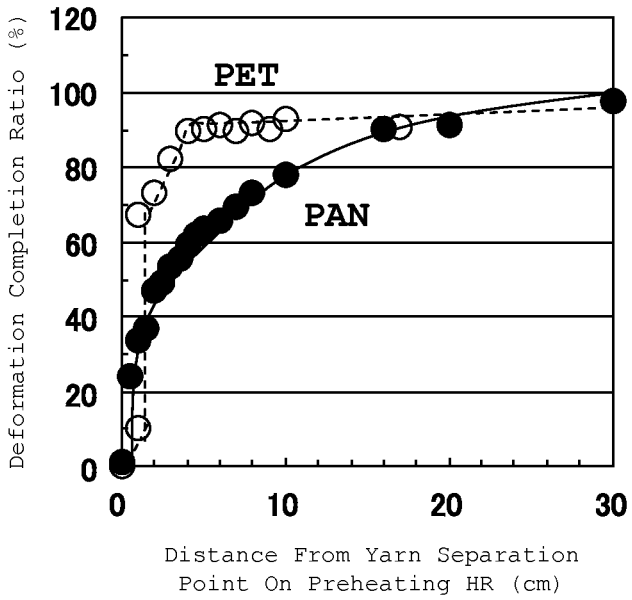
FIG. 1 is a graph showing a deformation profile during drawing.

2-1: Preheating Roll (First Hot Roll)
2-2: Take-up Roll
2-3: Undrawn Yarn
2-4: Drawing Length
3-1: Undrawn Yarn
3-2: Feed Roll
3-3: Preheating Roll
3-4: Hot Plate
3-5: HR-HPL Distance
3-6: Take-up Roll
3-7: Cold Roll
5-1: Undrawn Yarn
5-2: Feed Roll
5-3: First Hot Roll
5-4: Second Hot Roll
5-5: Third Hot Roll
5-6: Fourth Hot Roll
5-7: Cold Roll
5-8: Insulation box
6-1: Undrawn Yarn
6-2: Feed Roll
6-3: First Hot Roll
6-4: Second Hot Roll
6-5: Third Hot Roll
6-6: Fourth Hot Roll
6-7: Fifth Hot Roll
6-8: Sixth Hot Roll
6-9: Cold Roll
7-1: Undrawn Yarn
7-2: Feed Roll
7-3: First Hot Roll
7-4: Second Hot Roll
7-5: Third Hot Roll
7-6: Fourth Hot Roll
7-7: Fifth Hot Roll
7-8: Sixth Hot Roll
7-9: Seventh Hot Roll
7-10: Eighth Hot Roll
7-11: Cold Roll
8-1: Undrawn Yarn
8-2: Feed Roll
8-3: First Hot Roll
8-4: First Hot Plate
8-5: Second Hot Roll
8-6: Second Hot Plate
8-7: Third Hot Roll
8-8: Third Hot Plate
8-9: Fourth Hot Roll
8-10: Cold Roll

DETAILED DESCRIPTION

Our methods will, hereinafter, be described with desirable examples in detail. Polyacrylonitrile (PAN) is a polymer obtained by polymerizing an acrylonitrile monomer (hereinafter referred to as AN). It can also contain a copolymerization component other than AN. As the copolymerization component other than AN, for example, acrylic acid, methacrylic acid, itaconic acid, and alkali metal salts, ammonium salts and lower alkyl esters thereof; acrylamide and derivatives thereof; allylsulfonic acid, methallyl sulfonic acid and salts or alkyl esters thereof can be used. In the case where a PAN fiber is used as a carbon fiber precursor, it is particularly preferred to use itaconic acid as a copolymerization component other than AN, from the viewpoint of accelerating oxidization with a small amount of copolymerization. It should be noted that less content of the copolymerization component other than AN is preferable for the following reasons, and an AN-derived component in PAN is preferably 95% by mass or more. That is, a higher content of the AN-derived component can achieve less mass reduction due to thermal decomposition when the PAN fiber is subjected to an oxidization and carbonization treatment to form a carbon fiber so that the yield of the carbon fiber can be improved. At the same time, generation of a defect in the carbon fiber due to thermal decomposition can be inhibited, thereby suppressing deterioration of mechanical properties of the carbon fiber. From this viewpoint, the AN-derived component in PAN is more preferably 99% by mass or more. The PAN having a large content of copolymerization component other than AN used in the so-called acrylic fiber for clothing disclosed in JP '141 or the like exerts the effect of improving stretchability and stainability. At the time of an oxidization and carbonization treatment to form a carbon fiber, however, such a copolymerization component does not contribute to formation of a graphene sheet, which may cause a defect. The defect can deteriorate the mechanical properties of the carbon fiber. It is, therefore, believed that the PAN fiber is not suitable as a carbon fiber precursor.

The method of manufacturing a PAN fiber includes a spinning process in which a spinning dope containing PAN is spun, a first drawing process, a drying process, and a second drawing process. Hot drawing to be described later is performed as the second drawing process instead of drawing using the conventional steam tube.

The feature of our methods is based on the following specificity of the hot drawing of the PAN fiber. To explain this, a comparison of thinning behavior during the hot HR drawing of a polyester (PET) fiber and a PAN fiber, which are typical examples for performing HR drawing, is shown in FIG. 1. FIG. 1 is a graph obtained by subjecting a yarn to HR drawing, measuring the change in yarn speed during the HR drawing on-line with a laser Doppler velocimeter, normalizing the yarn speed with respect to a surface speed of a take-up roll to obtain a deformation completion ratio, and plotting the deformation completion ratio against a distance from a yarn separation point on a preheating HR. As for PAN, the preheated HR had a surface speed of 100 m/min and a temperature of 180° C. and the second HR had a surface speed of 200 m/min and a temperature of 180° C. On the other hand, as for PET, the preheated HR had a surface speed of 140 m/min and a temperature of 90° C. and the second HR had a surface speed of 196 m/min and a temperature of 130° C. It should be noted that the temperatures of PAN and PET are differently set because their polymers have different softening temperatures. The preheating HR means a first hot roll in a drawing zone while the second HR means a hot roll subsequent to the preheating HR. Since the draw ratio for PET decreased when the surface temperature of the preheating HR was set to approximately 130° C., the preheating temperature was set to 90° C. which is a normal temperature condition of a PET fiber for clothing. Since the preheating temperature of PAN is preferably 180° C. or higher as described later, such a temperature condition was set for PAN. We found that the plot of PET shows abrupt neck-shaped deformation near the preheating HR whereas the plot of PAN is slowly deformed from the yarn separation point on the preheating HR across approximately 30 cm during cooling.

Thus, there is a great difference between PAN and PET such that deformation of PAN proceeds during cooling whereas the deformation of PET proceeds in approximately isothermal conditions before cooling. It has been assumed that the deformation of PAN proceeds even at a low temperature so that a drawing stress easily increases, which can inhibit deformation at a high draw ratio. Therefore, for the purpose of high ratio drawing in the drawing process of PAN, it is believed to be important to keep the yarn at a high temperature to complete the drawing. We seek to eliminate a low-temperature drawing region observed in normal HR drawing of PAN by the following method. Such elimination is believed to allow the drawing stress to be reduced so that drawing even at a high ratio may enable smooth deformation to proceed.

Our method of manufacturing the polyacrylonitrile fiber is characterized by including, as the second drawing process, any of the following hot drawing processes (a) to (c):

(a) a process of performing, as the second drawing, hot drawing with a plurality of rolls, at least one of which is a hot roll, in the air setting a yarn temperature from a yarn separation point on the hot roll to a first yarn contact point on the subsequent roll to 130° C. or higher;

(b) a process of performing, as the second drawing, hot drawing with a plurality of rolls, at least one of which is a hot roll, setting a distance from the yarn separation point on the hot roll to the first yarn contact point on the subsequent roll to 20 cm or less; and (c) a process of performing the second drawing in a hot plate drawing zone where a hot plate is placed between two rolls, one of which is a preheating roll arranged forward of the hot plate drawing zone, while the hot plate is positioned so that the start point of contact between the hot plate and the yarn is at a distance of 30 cm or less from the yarn separation point on the preheating roll, and the surface speed of the preheating roll is set to 100 m/min or more.

The above-mentioned process (a) will be described in detail.

This hot drawing process uses a plurality of rolls, at least one of which is a hot roll (HR). This HR is used for preheating a yarn before drawing. That is, in the case where a pair of rolls is used, this HR is a front roll. It is hereinafter referred to as a preheating HR. Since neither HR nor rolls abrade a fiber, the fiber is not excessively abraded, so that an oil agent for the PAN fiber is hardly adhered or deposited. As a result, fuzz or yarn breakage is unlikely to occur.

The most characteristic feature of the process (a) is to keep the yarn temperature at a high temperature of 130° C. or higher from the yarn separation point on the preheating HR to the first yarn contact point on the subsequent roll. A region in which hot drawing is performed in the process (a), i.e., a region including the yarn kept at 130° C. or higher between one pair of rolls is referred to as a specific drawing zone. As described above, it is preferable that a drawing device to be in contact with the yarn in the specific drawing zone is a roll only, from the viewpoint of suppressing deposition or sticking of an oil agent for fibers.

Keeping the yarn temperature high in the specific drawing zone means that the yarn preheated with the preheating HR is drawn in the air before cooling, and the preheated yarn is taken up with a subsequent roll, to thereby complete drawing deformation with the yarn temperature kept high. In the case of conventional drawing using the preheating HR and the subsequent roll (hereinafter referred to as HR drawing), the drawing process has been designed such that a yarn is preheated on the preheating HR, then cooled in the air, and taken up with the subsequent roll, which is completely different from our method in the technical concept. A feature of our method is based on the specificity of the PAN hot drawing mentioned above. It seeks to eliminate a low-temperature drawing region observed in normal HR drawing of PAN by drawing with the yarn temperature kept high until the yarn enters into the take-up roll in the rear.

Next, the yarn temperature will be specifically described. The yarn temperature can be measured with a non-contact type thermometer such as a thermograph. The yarn temperature was measured at the time of drawing with a preheating HR temperature of 180° C. and a preheating HR surface speed of 100 m/min. When the yarn separation point on the preheating HR was set to 0 cm, the measurements of the yarn temperature at points of 5 cm, 10 cm, 20 cm, and 30 cm were 161° C., 150° C., 136° C., and 127° C., respectively. At the 30 cm point at which the deformation completion ratio of the PAN fiber was approximately 100%, the yarn temperature was 127° C. Therefore, the drawing was performed at a yarn temperature of 130° C. or higher. When drawing deformation in the air is completed at a yarn temperature of 130° C. or higher, the deformation completes at the yarn temperature higher than in the normal HR drawing, which has revealed to improve stretchability. That is, it is important that the yarn temperature between the preheating HR and the subsequent roll in the specific drawing zone is kept at 130° C. or higher. Keeping such a yarn temperature can fully soften the yarn so that a draw ratio can be set higher. The yarn temperature between the rolls is preferably 150° C. or higher. In addition, setting the yarn temperature between the preheating HR and the subsequent roll in the specific drawing zone to 240° C. or lower does not excessively soften the yarn so that fuzz and yarn breakage can be suppressed.

To achieve the yarn temperature between HRs as described above, it is preferred to set a roll temperature as follows, for example. A higher preheating HR temperature in the specific drawing zone is preferable because it can sufficiently increase the yarn temperature. Specifically, the temperature of the preheating HR, i.e., the hot roll arranged forward of the specific drawing zone is preferably 160° C. or higher, more preferably 180° C. or higher. It should be noted that setting the temperature excessively high can cause yarn breakage so that the temperature is preferably set to 240° C. or lower.

The roll (take-up roll) arranged in the rear of the specific drawing zone may have room temperature, but is preferably a hot roll (HR) because the yarn temperature in the specific drawing zone is easily kept high. Specifically, it is preferable that the temperature of the take-up roll is set to 150° C. or higher. It should be noted that setting the temperature excessively high can cause yarn breakage so that the temperature is preferably set to 200° C. or lower, more preferably 180° C. or lower.

It is preferred to set the surface speed of the preheating HR in the specific drawing zone to 100 m/min or more, thereby enabling the final drawing speed, i.e., the take-up speed to be improved. In addition, it is preferred to set the take-up speed after the second drawing of the PAN fiber to 350 m/min or more, thereby improving productivity. The take-up speed is more preferably 600 m/min or more, even more preferably 800 m/min or more.

To achieve the yarn temperature between HRs as described above, proximity HR drawing in which a preheating HR shown in the following paragraph (b) and a take-up roll are brought extremely close to each other can also be preferably adopted. More specifically, it is preferred to extremely shorten a distance from the yarn separation point on the preheating HR to the first yarn contact point on the take-up roll as compared to the conventional HR drawing, that is, to 20 cm or less. Extreme shortening of the drawing length means to complete drawing at a high yarn temperature of 130° C. or higher by preheating the yarn to a high temperature with the preheating HR and taking up the preheated yarn with the subsequent roll by the time it is cooled.

Next, the above-mentioned process (b) will be described in detail.

This hot drawing process uses a plurality of rolls, at least one of which is a hot roll (HR). This HR is used for preheating a yarn before drawing. In the case where a pair of rolls is used, this HR is a front roll. It is hereinafter referred to as a preheating HR. Since neither HR nor rolls abrade a fiber, the fiber is not excessively abraded, so that an oil agent for the PAN fiber is hardly adhered or deposited. As a result, fuzz or yarn breakage is unlikely to occur.

The most characteristic feature of the process (b) is to extremely shorten a distance from the yarn separation point on the HR used for preheating to the first yarn contact point on the subsequent roll as compared to the conventional HR drawing, that is, to 20 cm or less. It should be noted that the distance from the yarn separation point on the HR to the first yarn contact point on the subsequent roll is hereinafter simply referred to as a drawing length. The state of extremely short drawing length can be achieved by bringing the HR and the subsequent roll extremely close to each other as shown in, for example, FIG. 2. Further, a region in which the hot drawing process is performed in the process (b), i.e., a region which includes the preheating HR, an extremely short drawn portion, and the subsequent roll in one pair of rolls is referred to as a specific drawing zone. As described above, it is preferable that a drawing device to be in contact with the yarn in the specific drawing zone is a roll only, from the viewpoint of suppressing deposition or sticking of an oil agent for fibers.

Extreme shortening of the drawing length means to complete drawing at a high yarn temperature by preheating the yarn to a high temperature with the preheating HR and taking up the preheated yarn with the subsequent roll by the time it is cooled. In the case of drawing using the preheating HR and the roll (hereinafter referred to as HR drawing), a usual process is designed such that a yarn is preheated on the preheating HR, then cooled in the air, and taken up with the subsequent roll, which is completely different from our method in the technical concept and roll arrangement. A feature of our method is based on the specificity of the PAN hot drawing mentioned above. It seeks to eliminate a low-temperature drawing region observed in normal HR drawing by extremely shortening the drawing length to let the drawing proceed before the yarn is cooled.

Setting the drawing length in the specific drawing zone to 20 cm or less can provide a remarkable effect of improving stretchability. It is preferred to set the drawing length to 10 cm or less, since a more remarkable effect of improving stretchability can be provided. Further, setting the drawing length to 10 cm or less is preferable because a region deformed by drawing is shortened, so that the effect of fixing a drawing point is obtained, resulting in reduction of yarn unevenness. In the conventional hot plate drawing, drawing is performed with a drawing length of approximately 100 cm as disclosed in JP '333 or JP '613 in many cases. Since the yarn continues to deform over 100 cm under a high temperature, there is a problem such that the drawing point cannot be fixed, thereby increasing yarn unevenness. Our methods, however, can solve this problem. On the other hand, the practical lower limit of the drawing length is 1 cm from the viewpoint of a device design level.

Although the yarn temperature between rolls in the specific drawing zone lowers as the yarn separates from the preheating HR, keeping the yarn temperature between the preheating HR and the subsequent roll in the specific drawing zone at 130° C. or higher can fully soften the yarn, which enables the draw ratio to be set high. Therefore, the yarn temperature is preferably 150° C. or higher. In addition, setting the yarn temperature between the preheating HR and the subsequent roll in the specific drawing zone to 240° C. or lower does not excessively soften the yarn, so that fuzz and yarn breakage can be suppressed. The yarn temperature can be measured with a non-contact type thermometer such as a thermograph. The yarn temperature was measured at the time of PAN drawing with a preheating HR temperature of 180° C. and a preheating HR surface speed of 100 m/min. When the yarn separation point on the preheating HR was set to 0 cm, the measurements of the yarn temperature at points of 5 cm, 10 cm, 20 cm, and 30 cm were 161° C., 150° C., 136° C., and 127° C., respectively. On the other hand, the measurements of the yarn temperature at points of 10 cm, 20 cm, and 30 cm at a preheating HR surface speed of 12 m/min were 131° C., 97° C., and 71° C., respectively. As a result of this, we found that cooling in relation to the distance is slow in high-speed drawing, and that shortening of the drawing length allows drawing deformation to proceed while the yarn temperature is kept high. In addition, since the yarn temperature at the 20-cm point is 136° C. with high-speed drawing at a preheating HR surface speed of 100 m/min, we found that setting the drawing length to 20 cm provides a yarn temperature of 136° C. or higher even if the take-up roll has room temperature. Further, since the yarn temperature at the 30-cm point at which the deformation completion ratio is 100% is 127° C., we found that the yarn temperature during drawing in this example is preferably higher than that, specifically, 130° C. or higher. On the other hand, when the preheating HR surface speed is as low as 12 m/min, the yarn temperature at the 20-cm point is 97° C., and it has been assumed that shortening the drawing length hardly affects drawing deformation.

To achieve a preferable yarn temperature, it is preferred to set a roll temperature as follows, for example. A higher preheating HR temperature in the specific drawing zone is preferable because it can sufficiently increase the yarn temperature. Specifically, the temperature of the preheating HR, i.e., the first hot roll in the specific drawing zone is preferably 160° C. or higher, more preferably 180° C. or higher. It should be noted that setting the temperature excessively high can cause yarn breakage so that the temperature is preferably set to 240° C. or lower.

The take-up roll on the rear side may have room temperature, but is preferably a hot roll (HR) because the yarn temperature in the specific drawing zone is easily kept high. Specifically, it is preferable that the temperature of the take-up roll on the rear side, i.e., the roll subsequent to the preheating HR is set to 150° C. or higher. It should be noted that setting the temperature excessively high can cause yarn breakage so that the temperature is preferably set to 200° C. or lower, more preferably 180° C. or lower.

Setting the surface speed of the preheating HR to 100 m/min or more can improve the final drawing speed, i.e., the take-up speed, and therefore it is preferable. A technical point of this example, that is, the effect of improving stretchability by extremely shortening the drawing length and forcibly drawing the yarn at high yarn temperature easily becomes apparent as the drawing speed is higher. The reasons are as follows. In HR drawing of PAN, deformation continues over a long distance as shown in FIG. 1. However, the higher the drawing speed is, the longer the distance for which the deformation continues is. For example, when the preheating HR has a low speed with a surface speed of approximately 12 m/min, deformation is substantially completed within a distance of merely approximately 6 cm from the yarn separation point on the preheating HR. However, when the preheating HR has a surface speed of 100 m/min, deformation progresses over 30 cm, so that the effect becomes remarkable, which is preferable. For this reason, acceleration of drawing speed enables effective utilization of the technical point of this example. Further, since the surface speed of the preheating HR becomes higher at a later stage of the multistage drawing than in single-stage drawing, multistage drawing also has an advantage that improvement in stretchability is easily effectively exhibited by specifying the distance between rolls. The technical points explained above are specific to PAN which is a polymer to be deformed by drawing over a long distance. Setting the take-up speed after second drawing of the PAN fiber to 350 m/min or more is preferably because it improves productivity. The take-up speed is more preferably 600 m/min or more, even more preferably 800 m/min or more.

An example of a device which can be used in the specific drawing zone of the paragraph (b) will be described below. As mentioned above, the drawing device has a plurality of rolls, at least one of which is a hot roll. It is preferable that a distance from a point corresponding to the yarn separation point on the hot roll to a point corresponding to the first yarn contact point on the subsequent roll is 20 cm or less. As previously described, the conventional HR drawing device is designed such that the yarn which substantially completed drawing deformation is fully cooled and then taken up with a take-up roll or a heat set roll. Therefore, the distance between rolls in such a device is designed completely differently from that in our drawing device in which a yarn is forcibly deformed by drawing and then taken up while kept at a high temperature. For example, a usual drawing device of polyester can provide a drawing length of at least approximately 30 cm. Further, HR drawing is described in Comparative Example 1 of JP '613, and the drawing length (between FR and BR) in the example is approximately 131 cm as estimated from FIG. 2.

As the HR or the roll, a Nelson type roll around which a yarn is wound a plurality of times is preferable because such a roll can reliably increase the yarn temperature as well as grasp the yarn thereon even if the diameter of the roll is reduced and drawing is performed at a higher speed, resulting in less variation of deformation during drawing, thus achieving reduction of yarn unevenness. On the other hand, it is preferable to use a cantilever type roll as the HR and the roll from the viewpoints of simplification of equipment and ease of threading.

Since the rolls are brought close to each other in the paragraph (b), the distance between the rolls becomes narrow, which may reduce ease of threading. Therefore, the equipment can preferably perform threading in a state where the rolls are kept at some distance therebetween, and then move the rolls so that the rolls may be brought close to each other. It is more convenient to move the rolls under automatic control after threading.

Further, in this example, stretchability is improved by shortening the drawing length. Therefore, when threading is performed while the distance between the rolls is extended as mentioned above, a desired draw ratio cannot be achieved, so that threading may be impossible. For this reason, it is preferred to install a control in the drawing device, the control is one in which threading is first performed at a small surface speed rate between rolls, i.e., in the state of drawing at a low draw ratio, the surface speed of each roll is then synchronously increased, and a desired draw ratio and a desired take-up speed can be finally achieved.

Figure 2:
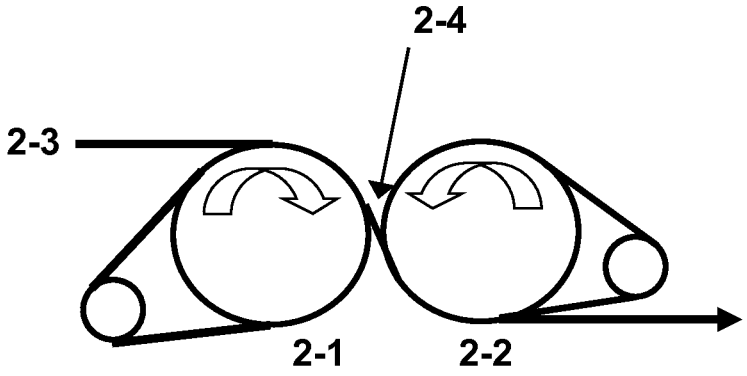
FIG. 2 is a drawing showing an example of a drawing device used in our methods.

Further, in the drawing device, threadability and shortening of drawing length can be both achieved by devising the rotation direction and the arrangement of the rolls. In particular, when a large diameter roll is used, the drawing length cannot be made equal to or shorter than the diameter of the roll by simply arranging the rolls as in the conventional drawing device. Therefore, it is effective to place the rolls in opposed relation, of which the rotation directions are reverse as shown in FIG. 2. For arrangement of the rolls, it is effective to arrange the rolls not only horizontally but also vertically or diagonally. Since PAN, which is a carbon fiber precursor, is often spun with a large fiber fineness such as the number of filaments of 12000 to 36000, a large diameter roll is used in many cases. Therefore, it is particularly effective to place the rolls in opposed relation, of which the rotation directions are reverse.

In addition, it is preferred to include a roll drive system capable of achieving a draw ratio of 1.5 times or more in the specific drawing zone and a surface speed of the preheating HR of 100 m/min or more.

Next, the above-mentioned process (c) will be described.

Figure 3:
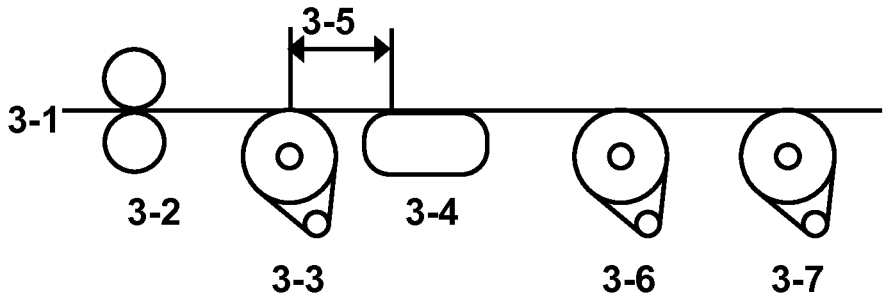
FIG. 3 is a drawing showing an example of a drawing device used in our methods.

In the hot drawing process, a configuration based on a construction (HR-HPL-R) in which a hot plate (HPL) is disposed after a hot roll (preheating HR) for preheating, and an additional roll is disposed behind the HPL is used. A region including this configuration, i.e., a region where the hot drawing process of (c) is performed, is referred to as a specific drawing zone. The roll on the rear side may be an HR. An example of a device which realizes such a specific drawing zone is shown in FIG. 3. An HPL is arranged between two rolls, one of which includes one preheating HR, and the preheating HR is arranged forward of the HPL.

It is preferred to perform high-speed drawing with the preheating HR having a surface speed of 100 m/min or more from the viewpoint of improvement in productivity. Considering the stringiness of PAN polymer and stability of the fluid surface in a coagulation bath, a water washing bath, or bath drawing, it is practical to set the surface speed of the preheating HR to 500 m/min or less. The surface speed of the preheating HR is preferably 160 m/min or less.

Similarly, from the viewpoint of improvement in productivity, the take-up speed after drawing is preferably 350 m/min or more, more preferably 600 m/min or more, even more preferably 800 m/min or more.

Figure 4:
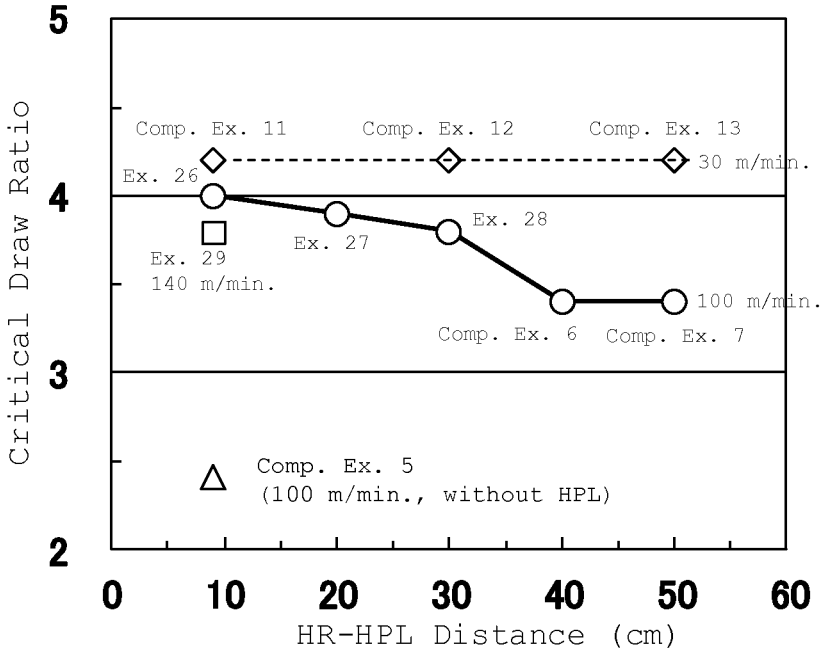
FIG. 4 is a graph showing the relationship between the HR-HPL distance and the critical draw ratio.

In this example, it is important to shorten the distance from the preheating HR to the HPL in the specific drawing zone, that is, to position the HPL so that the start point of contact between the HPL and a yarn is at a distance of 30 cm or less from the yarn separation point on the preheating HR. This is based on the discovery that the shorter the distance (HR-HPL distance) between the yarn contact start point on the HPL and the yarn separation point on the preheating HR is, the higher the effect of improving the critical draw ratio by the HPL is. The relationship between the HR-HPL distance and the critical draw ratio is illustrated in FIG. 4. The graph shows that the longer the HR-HPL distance is, the smaller the effect of improving the critical draw ratio becomes, whereas the shorter the HR-HPL distance is, the larger the effect of improving the critical draw ratio becomes. A feature of this example is based on the specificity of the PAN hot drawing mentioned above. For the purpose of high ratio drawing, it is considered important to keep the yarn at a high temperature to complete the drawing. The critical draw ratio refers to a draw ratio obtained when a draw ratio is gradually increased to cause a yarn to be broken.

That is, it is considered that the yarn is kept at a high temperature with the HPL to advance deformation before cooling of the yarn proceeds or before drawing deformation proceeds, so that a low-temperature deformation region of PAN is reduced, which can improve the critical draw ratio. On the other hand, even if an HPL is positioned after the yarn is already cooled or after drawing deformation is completed in normal HR-HR drawing, the deformed amount of the yarn by drawing on the HPL cannot be increased so that a low-temperature drawing region remains, which in turn deteriorates the effect of improving the critical draw ratio. Therefore, the HR-HPL distance is preferably 20 cm or less, more preferably 10 cm or less. This can further improve the critical draw ratio. A shorter HR-HPL distance is advantageous for improvement of the critical draw ratio. However, considering a current level of ease of threading, it is practical to set the lower limit of the HR-HPL distance to 1 cm.

A longer HPL length is preferable from the viewpoint of deforming a yarn while the yarn temperature is kept high. Specifically, an HPL length of 20 cm or more provides a satisfactory effect of improving the critical draw ratio. From the viewpoint of further improving the critical draw ratio, an HPL length of 45 cm or more is more preferable. However, from the viewpoint of fixing the drawing point to suppress yarn unevenness, a shorter HPL length is preferable. An oil agent for fibers or the like may be adhered, deposited, or stuck onto the HPL surface which a yarn contacts, which may induce fuzz or yarn breakage. From this viewpoint, a shorter HPL length is preferable. Specifically, an HPL length of 70 cm or less is preferable.

In the case where the oil agent for fibers predominantly contains silicone, the HPL surface soil resulting from the oil agent for fibers or the like may be hardened over time and further lead to generation of fuzz or yarn breakage. Therefore, it is preferable that the amount of HPL surface soil is always kept small by replacing the HPL or the yarn contact plate according to the amount of the PAN fiber passing on the HPL. For example, it is preferred to prepare a plurality of HPLs so that the HPL or the yarn contact plate can be automatically or manually replaced according to the time for doffing. To do this, losses due to the HPL replacement can be suppressed.

The residence time of the yarn on the HPL is preferably shortened to 0.05 to 0.5 seconds from the viewpoint of fixing the drawing point. The residence time is more preferably 0.25 seconds or less, even more preferably 0.15 seconds or less.

The HPL temperature is preferably higher from the viewpoint of keeping the yarn temperature high. Specifically, the HPL temperature is preferably set to 160° C. or higher, more preferably 180° C. or higher. On the other hand, setting the HPL temperature to 240° C. or lower can prevent the yarn from excessively softening, which can suppress the occurrence of fuzz and yarn breakage.

A higher preheating HR temperature can sufficiently increase the yarn temperature and is preferable. Specifically, the temperature of the preheating HR is preferably set to 160° C. or higher, more preferably 180° C. or higher. On the other hand, setting the preheating HR temperature to 240° C. or lower can prevent yarn from excessively softening, which can suppress the occurrence of fuzz and yarn breakage.

The take-up roll at the rear of the HPL may have room temperature but is preferably a hot roll (HR) because the PAN fiber structure can be easily stabilized. Specifically, the roll temperature is preferably set to 150° C. or higher. It should be noted that an excessively high temperature may cause yarn breakage to occur. Therefore, the roll temperature is preferably set to 200° C. or lower, more preferably 180° C. or lower.

In any of the processes (a) to (c) described above, the draw ratio in the specific drawing zone is preferably 1.5 times or more because productivity improves. The draw ratio is more preferably 2 times or more, even more preferably 2.5 times or more. In the case where a plurality of specific drawing zones are included in the hot drawing process, the draw ratio in any one of the specific drawing zones is required to be 1.5 times or more, but the draw ratio in the first specific drawing zone is preferably 1.5 times or more. There may be two or more specific drawing zones with a draw ratio of 1.5 times or more.

The second drawing process may include any one of the processes (a) to (c) mentioned above, but multistage drawing including some of these processes is preferably performed because the total draw ratio improves, leading to improvement in productivity. The number of drawing stages is preferably 2 or more. The multistage drawing is preferable because the larger the number of drawing stages is, the more the total draw ratio improves, so that productivity also improves. The number of drawing stages is more preferably 6 or more. It should be noted that it is practical to set the number of drawing stages to 8 or less since an excessive increase in the number of drawing stages can increase equipment cost.

The multistage drawing is required to include any one of the processes (a) to (c) mentioned above, but it is preferred to combine two or more processes because stretchability can further improve. Specifically, multistage drawing may be performed using an HPL as in HR-HPL-HR-HPL-HR, or may partially combine HPL drawing and HR drawing as in HR-HPL-HR-HR or HR-HR-HPL-HR. Or, an HR alone may be used for multistage drawing.

For example, by arranging five HRs, four-stage drawing can be performed. At this time, in the HR temperature setting, the temperature of the HR in the rear stages with the second HR and subsequent rolls is set lower than that of the first HR so that the first HR, which is a first preheating HR, has a temperature of 200° C. and the second HR and subsequent rolls have a temperature of 180° C., from the viewpoint of suppressing fuzz or yarn breakage.

The yarn is taken up with a winder after drawing, but an unheated cold roll is preferably placed before the winder because variations of take-up tension can be suppressed to reduce yarn unevenness.

In the processes (a) to (c) mentioned above, it is preferred to keep the yarn temperature by performing heating or keeping the temperature constant in the state of non-contact with the yarn.

Figure 5:
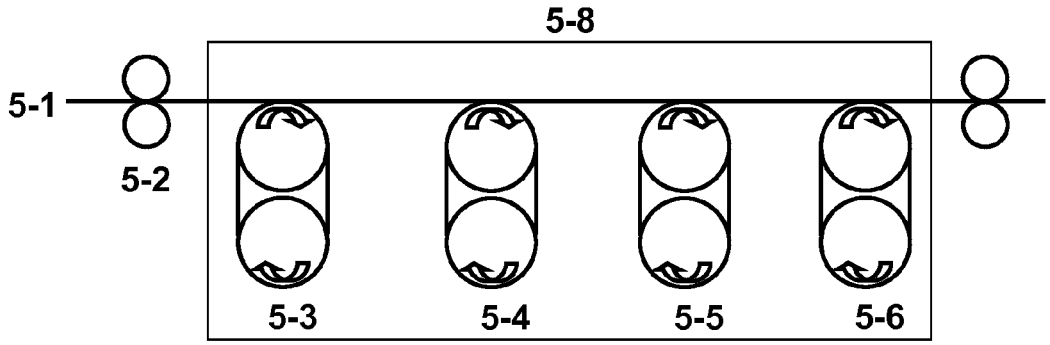
FIG. 5 is a drawing showing an example of a drawing device used in our methods.

As a means of performing heating or keeping the temperature constant, it is preferred to enclose the specific drawing zone by a heat insulation means which can perform heating or keep the temperature constant. For example, it is preferred to cover the specific drawing zone by having a heat insulation function to keep the ambient temperature high. Further, when a heating function is added to the means having the heat insulation function so that any ambient temperature can be set, cooling of the yarn during deformation by drawing can be suppressed, and drawing deformation can be advanced in a state where the yarn is kept at a high temperature. An example of a device which embodies such a function is shown in FIG. 5. In the device shown in FIG. 5, 4 sets of Nelson type HRs are combined, each set having two HRs in pair which rotate at the same surface speed. An undrawn yarn 5-1 is supplied through an unheated feed roll 5-2, and three-stage drawing is performed with HRs (5-3 to 5-6). Thereafter, a drawn yarn is taken up through an unheated cold roll 5-7. These 4 sets of HRs are covered with an insulation box 5-8 provided with a heater, so that the ambient temperature in the box can be kept at a desired temperature. In the case where such a device is used, there is no necessity of using a proximity HR or an HPL as long as the requirements for the process (a) mentioned above are satisfied. However, there is an advantage in that combination of the proximity HR or HPL drawing achieves compact design of a device having the above-mentioned heat insulation function.

A known device can be used as the device for heating the specific drawing zone or keeping the temperature thereof constant, but a freely openable box type device having the heat insulation function for the specific drawing zone is preferable from the viewpoint of ease of threading and compactness of the device.

As the method of heating the specific drawing zone or keeping the temperature thereof constant, a method of directly heating the yarn with a non-contact heater such as an infrared heater, a halogen heater, or hot air, from one direction or a plurality of directions is also preferable as well as the method of enclosing the specific drawing zone with the above-mentioned insulation means.

As the location where the yarn is heated or kept at a constant temperature in the specific drawing zone, at least a distance of 30 cm from the yarn separation point on the hot roll is preferably included because the yarn is greatly deformed and the effect of improving stretchability is enhanced.

The above-mentioned specific drawing zone may be provided separately after a drying process to be described later or may be included in the drying process to simplify the equipment to skip a process. At this time, it is preferable that a PAN fiber is fully dried to densify the structure of the PAN fiber, and the multistage drawing including the specific drawing process mentioned above is then performed with a drying roll so that a process can be skipped and drawing can be ensured. On the other hand, it is also possible to advance the multistage drawing including our specific drawing process while the PAN fiber is dried, which in turn enables further simplification of equipment. In addition, the specific drawing process is preferably applied to a device originally equipped with many drying rolls so that new equipment investment can be minimized.

It is preferable that the PAN fiber subjected to the second drawing process has an orientation degree of 60 to 85% obtained by wide angle X-ray diffraction. An orientation degree of 85% or less can lead to less occurrence of fuzz or yarn breakage even at a high draw ratio, resulting in improvement in productivity and therefore it is preferable. In addition, an orientation degree of 60% or more is practical for a polyacrylonitrile fiber before the second drawing. More preferably, the PAN fiber has an orientation degree of 65 to 83%.

The method of controlling the orientation degree is not limited, but it is preferred to suppress higher orientation of the PAN fiber in bath drawing in the spinning process or the first drawing process. Specifically, when techniques such as control of spinning speed, control of discharged amount, and selection of a spinneret hole size, are used alone or in combination, the tension at the time of coagulation can be reduced so that higher orientation of the PAN fiber can be suppressed.

It is preferred to improve the spinning speed to draw the PAN fiber at a high speed. For this purpose, it is effective to improve stringiness of PAN. To do that, as described in JP '219, it is preferable that large strain hardening of PAN arises, and the elongation viscosity of the spinning dope rapidly increases along with thinning of the spinning dope after discharge from the spinneret hole and until it is coagulated so that the spin line is stabilized. Then, to achieve the strain hardening, it is effective to use a blend polymer in which a small amount of ultra high molecular weight PAN is added to normal molecular weight PAN. The reason for this is believed to be that molecular chains of the normal molecular weight PAN and molecular chains of the high molecular weight PAN are entangled, and molecular chains between the entangled high molecular weight PAN are strained as elongated. Desired stringiness can be achieved with PAN having a z-average molecular weight ($M_z$) measured by a gel permeation chromatography (GPC) method of 800,000 to 6,000,000 and a degree of polydispersity of 2.5 to 10.

$M_z$ is obtained by dividing the total sum of values obtained by multiplying the square of the molecular weight of each molecular chain by the weight, by the total sum of values obtained by multiplying the molecular weight of each molecular chain by the weight. It is a parameter which reflects significant contribution of the high molecular weight component. The degree of polydispersity is referred to as $M_z/M_w$, and $M_w$ indicates a weight average molecular weight. As the degree of polydispersity becomes larger than 1, the molecular weight distribution is broader around the high molecular weight side. That is, when the degree of polydispersity specified above is from 2.5 to 10, it indicates that the high molecular weight component is contained. To increase the content of the high molecular weight component to facilitate causing strain hardening, $M_z$ and the degree of polydispersity are preferably larger. On the other hand, setting the upper limit thereof can prevent strain hardening from becoming excessively large so that discharge stability of the PAN solution from the spinneret hole can be ensured. From the above viewpoints, $M_z$ is preferably from 2,000,000 to 6,000,000, more preferably from 2,500,000 to 4,000,000, even more preferably from 2,500,000 to 3,200,000. In addition, the degree of polydispersity is preferably from 3 to 7, more preferably from 5 to 7. It should be noted that the molecular weight measured by the GPC method mentioned above is determined in terms of polystyrene. From the similar viewpoint, $M_w$ of PAN is preferably from 100,000 to 600,000.

In the measurement by the GPC method, to measure precisely up to an ultra high molecular weight, it is preferred to dilute the solution to an extent that no dependency of dissolution time on dilute concentration is found (i.e., viscosity change is small). It is also preferred to inject the solution as much as possible to obtain high detection sensitivity. Further, it is preferable that a solvent flow rate and a column are selected to prepare for broad molecular weight distribution measurement. An exclusion limit molecular weight of the column is at least 10,000,000, and it is preferred to set the molecular weight such that no tailing of peak is found. In general, measurement is made with a dilute concentration of 0.1 mass/vol % and an injection amount of 200 μL.

The PAN synthesizing method for accelerating the strain hardening as mentioned above and a solution preparing method will be explained as follows.

PAN which accelerates strain hardening can be obtained by mixing two kinds of PAN (written as A component and B component) different in molecular weight. The mixing means to finally obtain a mixture of the A component and the B component. A specific mixing method is described later and not limited to mix the respective single component.

First, two kinds of PAN to be mixed will be described below. When PAN with a large molecular weight is referred to as A component and PAN with a small molecular weight is referred to as B component, the weight average molecular weight ($M_w$) of the A component is preferably 1,000,000 to 15,000,000, more preferably 1,000,000 to 5,000,000. It is preferable that the $M_w$ of the B component is 150,000 to 1,000,000. As the difference of $M_w$ between the A component and the B component is larger, the degree of polydispersity $M_z/M_w$ of the mixed PAN is apt to become larger, which is preferable. When $M_w$ of the A component exceeds 15,000,000, polymerization productivity of the A component may be deteriorated. When $M_w$ of the B component is less than 150,000, strength of the PAN fiber which is a carbon fiber precursor may become insufficient.

It is preferable that the $M_w$ ratio of the A component to the B component is 2 to 45, more preferably 4 to 45, even more preferably 20 to 45.

In addition, it is preferable that a mass ratio of A component/B component is 0.001 to 0.3, more preferably 0.005 to 0.2, even more preferably 0.01 to 0.1. When the mass ratio of the A component to the B component is less than 0.001, the strain hardening is insufficient in some cases. When it is larger than 0.3, viscosity of the PAN solution becomes excessively high so that discharge becomes difficult in some cases.

The $M_w$ and the mass ratio of the A component and the B component are determined by peak splitting of peaks of molecular weight distribution measured by GPC, and calculating $M_w$ and peak area ratio of the respective peaks.

To prepare a PAN solution containing the A component and the B component, a method of mixing both the components and dissolving the mixture in a solvent; a method of mixing components each dissolved in a solvent with each other; a method of first dissolving the A component which is a high molecular weight substance hard to be dissolved in a solvent, and then mixing the B component with the resulting solution; and a method of first dissolving the A component which is a high molecular weight substance in a solvent, and then mixing a monomer constituting the B component with the resulting solution to subject the monomer to solution polymerization, can be employed. From the viewpoint of uniformly dissolving the high molecular weight substance, the method of first dissolving the A component which is a high molecular weight substance is preferable. From the viewpoint of simplifying the process, the method of first dissolving the A component which is a high molecular weight substance, and then mixing a monomer constituting the B component, to subject the monomer to solution polymerization is more preferable.

In particular, in the case where the PAN fiber is used as a carbon fiber precursor, the state of dissolution of the A component which is a high molecular weight substance is extremely important, and in the case where even a very small amount of undissolved substance remains such a foreign substance may form voids inside the carbon fiber.

As for the polymer concentration of the above-mentioned A component, the component is, as an assembled state of the polymers, controlled into a semi-dilute solution in which the polymers slightly overlap. When the B component is mixed or when the monomer constituting the B component is mixed, the mixed state is apt to become uniform. Therefore, it is more preferred to control the component into a dilute solution in which the polymers come into a state of isolated chain. Specifically, the concentration of the above-mentioned A component is preferably 0.1 to 5% by mass. The concentration of the above-mentioned A component is more preferably 0.3 to 3% by mass, even more preferably 0.5 to 2% by mass. Since the concentration of a dilute solution is considered to be determined by the intramolecular excluded volume which is determined by the molecular weight of the polymer and solubility of the polymer in a solvent, it cannot be flatly decided, but by controlling the concentration into approximately the above-mentioned range, performance of a carbon fiber can be maximized in most cases. When the concentration of the above-mentioned A component exceeds 5% by mass, a dissolved substance of the A component may remain, and when it is less than 0.1% by mass, although it depends on the molecular weight, strain hardening is weak in most cases because the solution has already become a dilute solution.

As the method to make the concentration of the A component in the solution 0.1 to 5% by mass, either a method in which the A component is dissolved in a solvent and then diluted, or a method in which the monomer constituting the A component is subjected to solution polymerization is acceptable. When the A component is dissolved and then diluted, it is important to stir the solution until it can be uniformly diluted. A dilution temperature of 50 to 120° C. is preferable. The dilution time may be appropriately set because it varies according to the dilution temperature or concentration before the dilution. When the dilution temperature is lower than 50° C., the dilution may take a long time, and when it exceeds 120° C., the A component may deteriorate.

From the viewpoint of eliminating the process of diluting the overlap of polymers and mixing the components uniformly, a method is preferable, in which when the A component is prepared by solution polymerization, the polymerization is stopped at a polymer concentration of 5% by mass or less, and the B component is mixed thereinto or the monomer constituting the B component is mixed thereinto to polymerize the monomer. From the viewpoint of simplifying the process, it is preferred to solution polymerize the B component after the solution polymerization of the A component, by using the unreacted monomer. Specifically, a polymerization initiator is introduced into a solution containing a monomer of which main component is AN, the A component is first prepared by solution polymerization, and before the solution polymerization completes, the B component is prepared by additionally introducing the polymerization initiator separately to solution polymerize the residual unreacted monomer so that a PAN solution containing the A component and the B component can be obtained. Preferably, the polymerization initiator is introduced in at least two portions, and a ratio of amount introduced of the polymerization initiator at the first time to the other amount introduced (amount introduced at first time/other amount introduced) is set to 0.1 or less, more preferably 0.01 or less, and even more preferably 0.003 or less. The smaller the amount of the polymerization initiator at the first time is, the more easily the molecular weight increases. Therefore, when the ratio between the amounts introduced (amount weighed and introduced at the first time/other amount weighed and introduced) exceeds 0.1, a required $M_w$ is hard to be obtained in some cases. On the other hand, when the amount of the polymerization initiator at the first time is small, the polymerization speed becomes low and productivity is easily deteriorated. Therefore, it is preferable that a lower limit of the ratio between amounts introduced (amount weighed and introduced at first time/other amount weighed and introduced) is 0.0001.

To control the $M_w$ of the A component, it is preferable that the molar ratio of AN to the polymerization initiator is controlled. In each of the amounts introduced at the first time, the molar ratio (polymerization initiator/AN) is preferably $1\times10^{-7}$ to $1\times10^{-4}$. In the amount introduced at the second time and thereafter, the molar ratio of total AN (regardless of reacted or unreacted) to the polymerization initiator (polymerization initiator/AN) introduced before that is preferably $5\times10^{-4}$ to $5\times10^{-3}$. When the copolymerization composition is changed between the A component and the B component, a copolymerizable monomer may be added when the polymerization initiator is introduced at the second time and thereafter. In such a case, AN, a chain transfer agent, or a solvent may be added.

As the polymerization initiator, an oil-soluble azo compound, a water-soluble azo compound, a peroxide or the like is preferable. From the viewpoints of handleability in view of safety and industrial efficiency of polymerization, a polymerization initiator of which radical generation temperature is 30 to 150° C., more preferably 40 to 100° C., is preferably used. Among them, an azo compound, which has no fear of generating oxygen which inhibits polymerization when it is decomposed, is preferably used, and in the case of polymerization by solution polymerization, an oil-soluble azo compound is preferably used from the viewpoint of solubility. Specific examples of the polymerization initiator include 2,2'-azobis(4-methoxy-2,4-dimethyl valeronitrile) (radical generation temperature 30° C.), 2,2'-azobis(2,4'-dimethyl valeronitrile) (radical generation temperature 51° C.), and 2,2'-azobisisobutylonitrile (radical generation temperature 65° C.). As the polymerization initiator at the first time and other than that, the same polymerization initiator may be used, or the amount of radicals generated by the polymerization initiator can be controlled by combining a plurality of polymerization initiators. In addition, when a peroxide is used as the polymerization initiator, a reducing agent may be used together to accelerate the generation of radicals.

A preferable range of the polymerization temperature varies according to the kind and amount of the polymerization initiator, but it is preferably 30° C. or higher and 90° C. or lower. When the polymerization temperature is lower than 30° C., the amount of radicals generated by the polymerization initiator decreases. When the polymerization temperature exceeds 90° C., it is higher than the boiling point of AN so that production control may often become difficult. The polymerization after introducing the polymerization initiator at the first time and the polymerization after introducing the polymerization initiator at the second time or thereafter may be performed at the same polymerization temperature, or may be performed at different polymerization temperatures.

When oxygen is present together during polymerization, it consumes the radicals. Therefore, a lower oxygen concentration during polymerization makes it easy to obtain a high molecular weight substance. The oxygen concentration during polymerization can be controlled by, for example, replacing the atmosphere in a reaction vessel with an inert gas such as nitrogen or argon. From the viewpoint of obtaining high molecular weight PAN, the oxygen concentration during polymerization is preferably 200 ppm or less.

Regarding measurement of the mass content ratio of the A component to the total PAN, when the A component and the B component are mixed together, the weight of the A component before the mixing and the mass of the total PAN after the mixing are measured, and the mass content ratio can be calculated from the mass ratio. Further, when the monomer constituting the B component is mixed with the A component to solution polymerize the monomer, the weight of the A component in the solution before the polymerization initiator for polymerizing the B component is introduced is measured after polymerization of the A component, and the mass of the total PAN in the solution after polymerization of the B component is measured, and the mass content ratio can be calculated from the mass ratio.

As the composition of the PAN polymer which is the A component, it is preferable that the AN-derived component is 98 to 100% by mol. A monomer copolymerizable with AN may be copolymerized in an amount of 2% by mol or less, but when a chain transfer constant of the copolymerization component is smaller than that of AN and a required $M_w$ is hard to be obtained, it is preferable that the amount of the copolymerization component is decreased as much as possible.

In the A component, as monomers copolymerizable with AN, for example, acrylic acid, methacrylic acid, itaconic acid, and alkali metal salts, ammonium salts and lower alkyl esters thereof; acrylamide and derivatives thereof; allylsulfonic acid, methallyl sulfonic acid and salts or alkyl esters thereof can be used. When the monomer is used for producing a precursor fiber of a carbon fiber, it is preferable that a degree of acceleration of oxidization is made almost the same as that of the B component from the viewpoint of improving the strand strength of the carbon fiber to be obtained, and to accelerate oxidization with a small amount of copolymerization, itaconic acid is especially preferable as the copolymerizable monomer.

The polymerization method of producing the A component can be selected from a solution polymerization method, a suspension polymerization method, an emulsion polymerization method, and the like. For the purpose of uniform polymerization of AN and the copolymerization component, however, it is preferred to employ a solution polymerization method. When a solution polymerization method is used for the polymerization, a solvent in which PAN is soluble, such as an aqueous solution of zinc chloride, dimethyl sulfoxide, dimethyl formamide, or dimethyl acetamide is preferably used as the solvent. When it is difficult to obtain a required $M_w$, a solution polymerization method using a solvent which has a high chain transfer constant, that is, an aqueous solution of zinc chloride, or a suspension polymerization method using water is preferably used.

As the composition of the PAN polymer which is the B component, the AN-derived component is preferably 98 to 100% by mol. Although 2% by mol or less of a monomer copolymerizable with AN may be copolymerized, the larger the amount of the copolymerization component is, the more serious the molecular scission by thermal decomposition at a copolymerized portion becomes, resulting in decrease of the strand strength of a carbon fiber to be obtained. In the B component, as the monomer copolymerizable with AN, for example, acrylic acid, methacrylic acid, itaconic acid, and alkali metal salts, ammonium salts and lower alkyl esters thereof; acrylamide and derivatives thereof; allylsulfonic acid, methallyl sulfonic acid and salts or alkyl esters thereof can be used from the viewpoint of accelerating oxidization.

From the viewpoint of stabilizing the discharge during spinning, it is also a preferable example to cross-link an AN main chain with a copolymerizable monomer. As such a monomer, a compound expressed by (meth)acryloyl group-$C_{1-10}$ linear or branched alkyl group-X-linear or branched $C_{1-10}$ alkyl group-(meth)acryloyl group (the alkyl group may be partially substituted with a hydroxyl group, X is any one of a cycloalkyl group, an ester group and an ester group-$C_{1-6}$ linear or branched alkyl group-ester group, or can be a single bond) is preferably used. The (meth)acryloyl group is an acryloyl group or a methacryloyl group. In particular, a compound expressed by (meth)acryloyl group-$C_{2-20}$ linear or branched alkyl group-(meth)acryloyl group is preferable. Specific examples of the compound include ethylene glycol dimethacrylate, 1,3-butylenediol diacrylate, neopentyl glycol diacrylate, and 1,6-hexanediol diacrylate. Although an appropriate value of the amount of copolymerization of the copolymerizable monomer used for cross-linking varies with the molecular weight of the polymer and cannot be flatly decided, the amount is preferably 0.001 to 1 mol, more preferably 0.01 to 0.3 mol, even more preferably 0.05 to 0.1 mol, per 100 mol of AN.

The polymerization method of producing the B component can be selected from a solution polymerization method, a suspension polymerization method, an emulsion polymerization method, and the like. For the purpose of uniform polymerization of AN and the copolymerization component, however, it is preferred to employ a solution polymerization method. When a solution polymerization method is used for the polymerization, a solvent in which PAN is soluble such as an aqueous solution of zinc chloride, dimethyl sulfoxide, dimethyl formamide, or dimethyl acetamide is preferably used as the solvent. Among them, dimethyl sulfoxide is preferably used from the viewpoint of solubility of PAN.

The method described in JP '219 can be used as the method for manufacturing a PAN fiber. Regarding the second drawing process, however, our hot drawing process is substituted for the steam drawing process. Specifically, the process from spinning to taking up as described below is performed.

First, the above-mentioned PAN is dissolved in a good solvent of PAN such as dimethyl sulfoxide (DMSO), dimethyl formamide (DMF), or dimethyl acetamide (DMA) to prepare a spinning dope. This spinning dope may contain a poor solvent such as water, methanol, or ethanol, as long as PAN is not coagulated in the spinning dope. Further, an antioxidant, a polymerization inhibitor, or the like may be contained in the range of 5% by mass or less with respect to PAN.

The concentration of PAN in the spinning dope is preferably 15 to 30% by mass. The spinning dope also preferably has a viscosity at 45° C. of 15 to 200 Pa·s. The viscosity can be measured by a B-type viscometer. More specifically, the spinning dope put in a beaker is put into a warm water bath having a temperature adjusted to 45° C. Using a B8L-type viscometer produced by Tokyo Keiki Inc. and a rotor No. 4, when the spinning dope has a viscosity of 0 to 100 Pa·s, the viscosity is measured at a rotor rotation speed of 6 rpm, and when the spinning dope has a viscosity of 100 to 1000 Pa·s, the viscosity is measured at a rotor rotation speed of 0.6 rpm.

The spinning dope can improve spinning properties by removing impurities and a gel through a filter prior to spinning, as well as provide a high strength carbon fiber. The filtration accuracy of the filter material is preferably 3 to 15 μm, more preferably 5 to 15 μm, and even more preferably 5 to 10 μm. The filtration accuracy of the filter material is defined by the particle size (diameter) of spherical particles of which 95% can be collected during the passage through the filter material. Therefore, the filtration accuracy of the filter material is associated with the pore size, and the filtration accuracy is generally enhanced by reducing the pore size. Setting the filtration accuracy to 15 μm or less can remove foreign matters such as impurities or a gel in the spinning dope, and can also suppress the occurrence of fuzz during drawing in the firing and drawing processes. On the other hand, setting the filtration accuracy to 3 μm or more can suppress capture of an ultrahigh molecular weight component contained in the spinning dope.

Next, in the spinning process, the spinning dope is discharged from a spinneret to be coagulated, thereby obtaining a coagulated yarn. As the spinning process, a known spinning method such as wet spinning, dry spinning, or dry jet spinning can be employed. From the viewpoint of accelerating the spinning speed and obtaining high spinning draft, dry jet spinning is preferable. A spinning draft of 1.5 to 15 is preferable. The spinning draft is a quotient calculateed by dividing the surface speed (take-up speed of coagulated yarn) of a roller having a driving source with which spinning yarn (filaments) first comes into contact after discharged from the spinneret by the discharge linear velocity at the spinneret hole, which means a ratio at which a spinning dope is drawn by the time it solidifies. In dry jet spinning, most of the deformation of the spinning dope occurs in the air, which can sufficiently exhibit the characteristics of PAN of large strain hardening. A large spinning draft allows the spinning speed to be accelerated, which can not only improve production efficiency, but also can easily make the fiber have a small fiber fineness, which is preferable. The upper limit of the spinning draft is specified as 15 considering the current industrial technical level. When the take-up speed of the coagulated yarn is 20 to 500 m/min, liquid surface disturbance of the coagulation bath can be suppressed and, at the same time, productivity can be improved. In addition, when the spinneret has a discharge hole diameter of 0.04 to 0.4 mm, the back pressure generated by the spinneret can be suppressed and, at the same time, a fiber with a small single fiber fineness can be obtained.

As a coagulation liquid in the coagulation bath, the above-mentioned poor solvent may be used alone or in combination with a good solvent. Alternatively, a coagulation accelerator can be used together. As a more specific composition, a mixture of DMSO and water can be used in consideration of compatibility between a good solvent and a poor solvent. Specific conditions of the coagulation liquid can be appropriately determined using a known method.

Next, the coagulated yarn is subjected to first drawing according to the first drawing process. In the first drawing process, the drawing may be performed in a bath or in the air. As the first drawing, bath drawing is common. At this time, when a warm water bath is used, not only good stretchability can be obtained, but also it is preferred to reduce a liquid recovery load and to improve safety as compared with the case where an organic solvent is used. It is preferable that the bath drawing temperature is 60 to 95° C., and the draw ratio is 1 to 5 times. The fiber is washed before and after the first drawing, but may be washed either before or after the first drawing. Washing by water is common.

Thereafter, an oil agent for fibers is given to the fiber subjected to the first drawing process. The oil agent for fibers is given to prevent adhesion between single fibers, and a silicone oil is usually used. In particular, use of amino-modified silicone which has high heat resistance can suppress a problem in a drying process or a second drawing process.

When the following drying process is performed under the conditions of 160 to 200° C. for 10 to 200 seconds, sufficient drying can be achieved and the structure of the PAN fiber can be densified, resulting in suppression of generation of voids, which is preferable.

Then, the above-mentioned specific hot drawing process is performed as a second drawing process after the drying process. As described above, our method has a feature in the second drawing process.

Our hot drawing method is generally effective for a PAN fiber. In particular, when the hot drawing method is applied to PAN capable of high-speed spinning and having a z-average molecular weight ($M_z$) of 800,000 to 6,000,000 and a degree of polydispersity of 2.5 to 10, not only the productivity dramatically improves, but also the method corresponds to the above-mentioned feature, which is preferable. When a conventional steam tube is used in high-speed spinning as the second drawing process, steam leakage from the steam tube increases, causing a significant energy loss. Further, the steam tube needs to be lengthened so that the amount of steam used increases and threading through the steam tube becomes remarkably difficult. Therefore, a significant loss may be caused at the time of production start or yarn breakage. Further, it becomes remarkably difficult to control temperature unevenness in the steam tube so that fuzz or yarn breakage is considered to be increased. When variations in drawing or structure of a PAN fiber to be obtained become significant, there is a fear that a defect tends to be induced even when a carbon fiber is manufactured by using the PAN fiber as a precursor fiber, leading to deterioration of mechanical properties of the carbon fiber. However, our hot drawing can thoroughly solve the problem of the combination of the high-speed spinning and the steam tube. Further, as compared to the drawing using a heat abrasive article such as a conventional hot plate or hot pin, the hot drawing is preferable from the viewpoint of an enhanced effect of fixing a drawing point and suppressing yarn unevenness since the distance of drawing deformation can be remarkably shortened.

Thus, our method of manufacturing a PAN fiber has a significant advantage as compared to a method of using the conventional steam drawing or the second drawing process using a heat abrasive article such as a hot plate or a hot pin. According to our methods, fuzz or yarn breakage in the hot drawing can be suppressed to a practical level for the first time, and a sufficient draw ratio can be ensured even in high-speed drawing, thereby taking advantage of hot drawing.

It is preferable that the single fiber fineness of the PAN fiber obtained is 0.1 to 1.5 dtex. When the PAN fiber is used as a precursor fiber of a carbon fiber, the smaller the single fiber fineness is, the more the mechanical properties of the carbon fiber can be enhanced. In contrast, a smaller single fiber fineness results in deterioration of process stability and productivity so that the single fiber fineness should be preferably selected in consideration of mechanical properties of the desired carbon fiber and cost. The single fiber fineness of the PAN fiber is more preferably 0.5 to 1.2 dtex, even more preferably 0.7 to 1.0 dtex.

Next, the obtained PAN fiber is used as a precursor fiber of a carbon fiber, subjected to a carbonization treatment so that a carbon fiber can be obtained. Preferably, the PAN fiber is treated for oxidization to obtain oxidized fiber, the oxidized fiber thus obtained is preliminarily treated for carbonization to obtain a preliminarily carbonized fiber, and the preliminarily carbonized fiber thus obtained is further treated for carbonization to obtain a carbon fiber. Specifically, the PAN fiber is treated for oxidization at a draw ratio of 0.8 to 2.5 in the air having a temperature of 200 to 300° C., to obtain a oxidized fiber. Then, the oxidized fiber thus obtained is treated for preliminary carbonization at a draw ratio of 0.9 to 1.5 in an inert gas atmosphere having a temperature of 300 to 800° C., to obtain a preliminarily carbonized fiber. Further, the preliminarily carbonized fiber thus obtained is treated for carbonization at a draw ratio of 0.9 to 1.1 in an inert gas atmosphere at a temperature of 1000 to 3000° C. so that a carbon fiber can be obtained. In particular, from the viewpoint of improving the strand modulus of the carbon fiber, it is preferable that carbonization is performed while a stress of 5.9 to 13.0 mN/dtex is provided to the fiber. The stress at this time is a value calculated by dividing a tension measured before the roller of the exit side of the carbonization furnace by the fineness of the PAN fiber absolutely dried. In addition, a multistage carbonization treatment is also preferable from the viewpoint of improvement of the strand modulus.

The carbon fiber obtained according to our method can be subjected to a variety of molding methods, for example, autoclave molding as a prepreg, resin transfer molding as a preform of a woven fabric or the like, and molding by filament winding. These molded articles are suitably used as aircraft members, pressure container members, automobile members, windmill members, or sporting members.

EXAMPLES

Hereinafter, our methods will be described in detail with reference to examples. The following methods were used for measurement in the examples.

A. Measurement of PAN Molecular Weight and Degree of Polydispersity by GPC

A polymer to be measured was dissolved in dimethyl formamide (0.01 N-lithium bromide was added) such that the concentration was 0.1% by mass, to obtain a sample solution. The sample solution was then subjected to the following GPC measurement. In the case of measuring a PAN fiber, the above-mentioned sample solution must be prepared by dissolving the PAN fiber in a solvent. However, denser PAN fibers with higher orientation are less likely to be dissolved, and PAN fibers tend to be measured to have a lower molecular weight as the dissolution time is longer and the dissolution temperature is higher. Therefore, the PAN fiber was finely ground and then dissolved over a day in a solvent controlled to 40° C. while stirring with a stirrer. For the obtained sample solution, a molecular weight distribution curve was obtained from a GPC curve measured under the following measurement conditions, and $M_z$ and $M_w$ were calculated. The measurement was performed 3 times and an average value among the measurements was adopted. The degree of polydispersity was obtained by $M_z/M_w$. It should be noted that dimethyl formamide and lithium bromide produced by Wako Pure Chemical Industries, Ltd. were used.

- GPC: CLASS-LC2010 produced by Shimadzu Corporation
- Column: Polar Organic Solvent Type GPC Column (TSK-GEL-α-M (×2) produced by Tosoh Corporation+TSK-guard Column a produced by Tosoh Corporation)
- Flow Rate: 0.5 mL/min
- Temperature: 75° C.
- Filtration of Sample: Membrane Filter (0.45μ-FHLP FILTER produced by Millipore Corporation)
- Amount of Injection: 200 μL
- Detector: Differential Refractometer (RID-10AV produced by Shimadzu Corporation)

A calibration curve of elusion time-molecular weight was created by using at least 6 types of monodispersed polystyrene different in molecular weight of which molecular weights were known, and a molecular weight in terms of polystyrene was read which corresponds to the elusion time on the calibration curve, thereby obtaining the molecular weight distribution. In this test, polystyrenes each having a molecular weight of 184,000, 427, 000, 791,000, 1,300,000, 1,810,000, and 4,240,000 were used as the polystyrene for preparing the calibration curve.

B. Viscosity of Spinning Dope

A spinning dope put in a beaker was put into a warm water bath having a temperature adjusted to 45° C. Using a B8L-type viscometer produced by Tokyo Keiki Inc. and a rotor No. 4, when the spinning dope had a viscosity of 0 to 100 Pa·s, the viscosity was measured at a rotor rotation speed of 6 rpm, and when the spinning dope had a viscosity of 100 to 1000 Pa·s, the viscosity was measured at a rotor rotation speed of 0.6 rpm.

C. Orientation Degree by Wide Angle X-Ray

The orientation degree in the fiber axis direction was measured as follows. A fiber bundle was cut into a length of 40 mm, 20 mg of the fiber bundle was precisely weighed and sampled, and the sampled fibers were aligned so that the sample fiber axis was accurately in parallel. Then, the aligned sample was made into a sample fiber bundle with a width of 1 mm and a uniform thickness using a jig for sample adjustment. The sample fiber bundle was impregnated with a dilute collodion solution to fix not to break the form thereof, and then fixed on a stage for wide angle X-ray diffraction measurement. With the use of a Cu—Kα ray rendered monochromatic through a Ni-filter as an X-ray source, a crystal orientation degree (%) was obtained with the use of the following formula, from the half width (H°) of a profile extended in the meridional direction including the maximum diffraction intensity observed in the vicinity of 2θ=17°. The measurement was performed 3 times and an average value among the measurements was calculated.

$$\text{Crystal orientation degree (\%)}=[(180-H)/180]\times 100$$

It should be noted that XRD-6100 produced by Shimadzu Corporation was used as the above-mentioned wide angle X-ray diffractometer.

D. Number of Fuzzes on PAN Fiber

The number of fuzzes per 300 m of the fiber was counted while the obtained fiber bundle was run at a rate of 1 m/min. A fiber in a fluff form was also counted as the fuzz. The results were evaluated as follows:

30 pieces or less: A (passed)

31 to 49 pieces: B (passed)

50 pieces or more: C (failed).

E. Yarn Breakage in PAN Spinning

In each experiment, continuous spinning was performed for 24 hours and the number of times of yarn breakage was counted. The results were evaluated as follows:

None: A (passed)

Once: B (passed)

Twice or more: C (failed).

F. Strand Strength and Strand Modulus of Carbon Fiber

The strand strength and strand modulus of the carbon fiber were evaluated in accordance with JIS R7601 (1986) "Test Method of Resin-impregnated Strand". The resin-impregnated strand of the carbon fiber to be measured was prepared by impregnating a carbon fiber or a graphitized carbon fiber with 3,4-epoxycyclohexyl methyl-3,4-epoxy-cyclohexylcarboxylate (100 parts by mass)/boron trifluoride monoethyl amine (3 parts by mass)/acetone (4 parts by mass), and curing the impregnated fiber at a temperature of 130° C. for 30 minutes. In addition, the number of strands of the carbon fiber to be measured was 6, and the average values among the respective measurement results were taken as the strand strength and the strand modulus. As the 3,4-epoxycyclohexyl methyl-3,4-epoxy-cyclohexyl-carboxylate, "Bakelite" (Registered Trademark) ERL4221 produced by Union Carbide Corporation was used herein.

G. On-Line Yarn Speed Measurement

To determine a deformation profile of the yarn during drawing, a yarn speed along the path of the yarn in the drawing region was measured using a non-contact speed measurement device produced by TSI (TSI-LDV LS 50S). At this time, a yarn separation position on the preheating HR was set to 0 cm. Then, the yarn speed at each measurement position was standardized with the surface speed of the take-up roll, to thereby obtain a deformation completion ratio.

H. On-Line Yarn Temperature Measurement

The yarn temperature during the drawing was measured with a thermograph (TH9100WR) produced by NEC Avio Infrared Technologies Co., Ltd. equipped with a 95-μm close-up lens. A thermographic base line was corrected, based on the roll temperature and yarn temperature (0 to 5 mm from the yarn separation point on the preheating HR) measured by a contact type thermometer, by emissivity correction and distance correction so that the value displayed on the thermograph corresponds to the temperature measured by the contact type thermometer.

Reference Example 1

Synthesis of PAN, Degree of Polydispersity=5.7

100 parts by mass of AN, 1 part by mass of itaconic acid, and 130 parts by mass of dimethyl sulfoxide were mixed, and the mixture was put in a reaction vessel equipped with a reflux tube and a stirring blade. After the space in the reaction vessel was replaced with nitrogen up to an oxygen concentration of 100 ppm, 0.002 parts by mass of 2,2'-azobisisobutyronitrile (hereinafter referred to as AIBN) was then supplied thereinto as a radical initiator, and a heat treatment was carried out under the following condition (polymerization condition A) while stirring.

(1) Maintaining at a temperature of 65° C. for 2 hours.

(2) Cooling from 65° C. to 30° C. (cooling speed 120° C./hour).

Next, 240 parts by mass of dimethyl sulfoxide, 0.4 parts by mass of AIBN as a radical initiator, and 0.1 parts by mass of octylmercaptan as a chain transfer agent were introduced into the reaction vessel and, furthermore, a heat treatment was carried out under the following condition while stirring. The remaining unreacted monomer was polymerized by a solution polymerization method, thereby obtaining a PAN polymer solution.

(1) Heating from 30° C. to 60° C. (heating speed 10° C./hour)

(2) Maintaining at a temperature of 60° C. for 4 hours.

(3) Heating from 60° C. to 80° C. (heating speed 10° C./hour)

(4) Maintaining at a temperature of 80° C. for 6 hours.

After the obtained PAN polymer solution was prepared to have a polymer concentration of 20% by mass, an ammonia gas was blown until the pH became 8.5 to introduce an ammonium group into the PAN polymer while neutralizing itaconic acid, thereby obtaining a spinning dope. The PAN polymer in the obtained spinning dope had a $M_w$ of 480,000, a $M_z$ of 2,740,000, a $M_z/M_w$ of 5.7, and a $M_{z+1}/M_w$ of 14, and the viscosity of the spinning dope was 45 Pa·s. The component A as a high molecular substance had a $M_w$ of 3,400,000, the component B as a low molecular substance had a $M_w$ of 350,000.

The obtained spinning dope was passed through a filter with a filtration accuracy of 10 um, and then discharged from a spinneret having 3,000 holes and a hole diameter of 0.19 mm (3,000 holes) at a temperature of 40° C. The spinning dope was discharged once into the air from the spinneret, and then allowed to pass through a space of about 2 mm. Thereafter, spinning was performed by a dry-jet spinning method for introducing the spinning dope into a coagulation bath made of an aqueous solution of 20% by mass dimethyl sulfoxide controlled to a temperature of 3° C. so that a swollen yarn was obtained. The obtained swollen yarn was washed with water, and subjected to a first drawing step in a bath at a tension of 2.2 mN/dtex. The bath temperature was 65° C. and the draw ratio was 2.7 times. An amino-modified silicone-based silicone oil solution was applied to the filaments subjected to the first drawing step, and a roller heated to a temperature of 165° C. was used to perform a dry heat treatment for 30 seconds so that a dry yarn having a single fiber fineness of 4.4 dtex was obtained. The final speed of the drying roller at this time was 140 m/min.

Reference Example 2

Synthesis of PAN, Degree of Polydispersity=2.7

A spinning dope was obtained in the same manner as in Reference Example 1, except that the first supply amount of AIBN was changed to 0.001 parts by mass, the space in the reaction vessel was replaced with nitrogen up to an oxygen concentration of 1000 ppm, and the polymerization condition A in Reference Example 1 was changed to the following polymerization condition B.

(1) Maintaining at a temperature of 70° C. for 4 hours.

(2) Cooling from 70° C. to 30° C. (cooling speed 120° C./hour).

The PAN polymer in the obtained spinning dope had a $M_w$ of 340,000, a $M_z$ of 920,000, a $M_z/M_w$ of 2.7, and a $M_{z+1}/M_w$ of 7.2, and the viscosity of the spinning dope was 40 Pa·s. The component A as a high molecular substance had a $M_w$ of 1,500,000, and the component B as a low molecular substance had a $M_w$ of 300,000. Spinning was performed in the same manner as in Reference Example 1, except that the spinning dope was changed to the above-mentioned one, to thereby obtain a dry yarn. The final speed of the drying roller at this time was 100 m/min.

Reference Example 3

Synthesis of PAN, Degree of Polydispersity=1.8

Uniformly dissolved were 100 parts by mass of AN, 1 part by mass of itaconic acid, 0.4 parts by mass of AIBN as a radical initiator, and 0.1 parts by mass of octylmercaptan as a chain transfer agent in 370 parts by mass of dimethyl sulfoxide, and the mixture was put in a reaction vessel equipped with a reflux tube and a stirring blade. After the space in the reaction vessel was replaced with nitrogen up to an oxygen concentration of 1000 ppm, a heat treatment was carried out under the following condition while stirring. The resulting mixture was polymerized by a solution polymerization method, thereby obtaining a PAN polymer solution.

(1) Heating from 30° C. to 60° C. (heating speed 10° C./hour)

(2) Maintaining at a temperature of 60° C. for 4 hours.

(3) Heating from 60° C. to 80° C. (heating speed 10° C./hour)

(4) Maintaining at a temperature of 80° C. for 6 hours.

After the obtained PAN polymer solution was prepared to have a polymer concentration of 20% by mass, an ammonia gas was blown until the pH became 8.5 to introduce an ammonium group into the polymer while neutralizing itaconic acid, thereby obtaining a spinning dope. The PAN polymer in the obtained spinning dope had a $M_w$ of 400,000, a $M_z$ of 720,000, a $M_z/M_w$ of 1.8, and a $M_{z+1}/M_w$ of 3.0, and the viscosity of the spinning dope was 50 Pa·s. In this PAN, a component equivalent to the component A as a high molecular substance was not observed. Spinning was performed in the same manner as in Reference Example 1, except that the spinning dope was changed to the above-mentioned one and the roller speed was changed, to thereby obtain a dry yarn. The final speed of the drying roller at this time was 50 m/min. Since the PAN used herein had a low degree of polydispersity, its stringiness was lower than those in Reference Examples 1 and 2 so that the yarn was not continuously connected at a final speed of the drying roller of 140 m/min. As a result, such PAN was not suitable for high-speed spinning.

Reference Example 4

PAN Dry Yarn Having Different Orientation

A spinning dope was obtained in the same manner as in Reference Example 1. The PAN polymer in the obtained spinning dope had a $M_w$ of 480,000, a $M_z$ of 2,740,000, a $M_z/M_w$ of 5.7, and a $M_{z+1}/M_w$ of 14, and the viscosity of the spinning dope was 45 Pa·s. The component A as a high molecular substance had a $M_w$ of 3,400,000, and the component B as a low molecular substance had a $M_w$ of 350,000.

The obtained spinning dope was passed through a filter with a filtration accuracy of 10 μm, and then discharged from a spinneret having 3,000 holes and a hole diameter of 0.19 mm (3,000 holes) at a temperature of 40° C. The spinning dope was discharged once into the air from the spinneret, and then allowed to pass through a space of about 2 mm. Thereafter, spinning was performed by a dry-jet spinning method for introducing the spinning dope into a coagulation bath made of an aqueous solution of 20% by mass dimethyl sulfoxide controlled to a temperature of 3° C. so that a swollen yarn was obtained. The obtained swollen yarn was washed with water and subjected to a first drawing step in a bath. The bath temperature was 65° C. and the draw ratio was 2.7 times. An amino-modified silicone-based silicone oil solution was applied to the filaments subjected to the first drawing step, and a roller heated to a temperature of 165° C. was used to perform a dry heat treatment for 30 seconds so that a dry yarn having a single fiber fineness of 4.4 dtex was obtained.

The final speed of the drying roller was changed to 30 m/min (Reference Example 4-1), 50 m/min (Reference Example 4-2), and 140 m/min (Reference Example 1), to obtain differently oriented PAN dry yarns. When the orientation degrees of the dry yarns were measured, the values were 82.0%, 82.5%, and 84.0%, respectively.

The final speed of the drying roller was set to 30 m/min, and the first draw ratio in a bath was changed from 2.7 times to 1.9 times (Reference Example 4-3) and 4.5 times (Reference Example 4-4), to obtain differently oriented PAN dry yarns. The orientation degrees of the dry yarns were 79.2% and 84.7%, respectively.

The final speed of the drying roller was set to 140 m/min, and the first draw ratio in a bath was changed from 2.7 times to 1.9 times (4-5) and 4.5 times (4-6), to obtain differently oriented PAN dry yarns. The orientation degrees of the dry yarns were 81.2% and 86.7%, respectively.

Reference Example 5

Yarn Speed Measurement During Drawing

The PAN dry yarn produced in the same manner as in Reference Example 1 except that the number of filaments of the PAN fiber was set to 100 was once taken up. Then, the taken up yarn was again subjected to drawing as follows. Homo PET having an intrinsic viscosity of 0.63 was spun, and then taken up at a rate of 600 m/min. The taken up yarn was subjected to HR drawing at a draw ratio of 3 times at a preheating HR temperature of 90° C. and a second HR temperature of 130° C., and then once taken up, to thereby obtain a PET fiber. Then, the PET fiber thus obtained was again subjected to drawing as follows.

A drawing device using a set of Nelson type mirror-finished HR including two HRs (each equipped with a driving mechanism) in pair was used. The distance between the HRs was 170 cm. In the case of PAN, the preheating HR had a surface speed of 100 m/min at a temperature of 180° C. and the second HR had a surface speed of 200 m/min at a temperature of 180° C. On the other hand, in the case of PET, the preheating HR had a surface speed of 140 m/min at a temperature of 90° C. and the second HR had a surface speed of 196 m/min at a temperature of 130° C. The results are shown in FIG. 1. It was found that the plot of PET showed abrupt neck-shaped deformation near the preheating HR whereas the plot of PAN was slowly deformed from the yarn separation point on the preheating HR across approximately 30 cm. The yarn speed of the PAN fiber was measured when the surface speed of the preheating HR was set to 12 m/min and the draw ratio was set to 2.0 times. The PAN fiber, however, reached a deformation completion ratio of 100% at a point approximately 6 cm from the yarn separation point on the preheating HR, thereby revealing that drawing deformation is completed at a much shorter distance than that during high-speed drawing.

Reference Example 6

Yarn Temperature Measurement During Drawing

The surface speed of the preheating HR was set to 12 m/min and 100 m/min, and the draw ratio was set to 2.0 times, and a PAN fiber was subjected to drawing in the same manner as in Reference Example 5. The change in yarn temperature at this time was measured. When the yarn separation point on the preheating HR was set to 0 cm, the measurements of the yarn temperature at drawn positions of 5 cm, 10 cm, 20 cm, and 30 cm at a preheating HR surface speed of 100 m/min were 161° C., 150° C., 136° C., and 127° C., respectively. On the other hand, measurements of the yarn temperature at drawn positions of 10 cm, 20 cm, and 30 cm at a preheating HR surface speed of 12 m/min were 131° C., 97° C., and 71° C., respectively. As a result of this, it was found that cooling in relation to the distance is slow in high-speed drawing, and that shortening of the drawing length allows drawing deformation to proceed while the yarn temperature is kept high. Since the yarn temperature at the 20-cm point was 136° C. in the high-speed drawing, it was also found that a drawing length of 20 cm or less provides a yarn temperature of 136° C. or higher even if the take-up roll has room temperature. In addition, since the yarn temperature was 127° C. at the 30-cm point with a deformation completion ratio of 100%, it is understood that the yarn temperature during drawing is preferably higher than that, specifically, 130° C. or higher. On the other hand, since the yarn temperature was 97° C. at the 20-cm point in low-speed drawing, it is assumed that a shorter drawing length hardly affects drawing deformation.

Examples 1 to 9

The PAN dry yarn of Reference Example 1 was taken up once, and the taken-up yarn as an undrawn yarn was then again subjected to second drawing. At this time, a drawing device was used in which one pair of Nelson rolls were transversely opposed to rotate in reverse direction to each other as shown in FIG. 2. Then, the temperatures of the preheating HR 2-1 and the take-up roll 2-2 were changed as shown in Table 1, and the distance between the two rolls was changed, to thereby change the drawing length. The surface speed of the preheating HR was set to 100 m/min. The maximum yarn temperature was determined as the preheating HR temperature, and the minimum yarn temperature was measured by actual measurement when the drawing length was 10 cm or longer. It was assumed that the minimum yarn temperature in the case of a drawing length of 3 cm was the same as the yarn temperature at the 3-cm point during normal HR drawing.

The comparisons among Examples 1 to 4 show that a shorter drawing length, i.e., a higher yarn temperature improves the draw ratio. The comparisons among Examples 1, 5, 7, and 8 show that the yarn temperature preferably does not exceed 240° C. from the viewpoint of suppressing fuzz and yarn breakage. In addition, these comparisons show that a higher temperature of the preheating HR improves the draw ratio and that the preheating HR temperature is preferably 180° C. or higher and 240° C. or lower, from the viewpoint of suppressing fuzz and yarn breakage. Similarly, the comparison between Examples 5 and 6 shows that the temperature of the take-up roll is preferably 180° C. or lower. On the other hand, the comparison between Examples 5 and 9 shows that the temperature of the take-up roll is preferably 150° C. or higher, from the viewpoint of improving the draw ratio.

Comparative Examples 1 to 3

Drawing was performed in the same manner as in Example 1 or 6, except that the drawing length was changed to 30 cm and 80 cm as shown in Table 1. The yarn temperature became less than 130° C. and the draw ratio was low.

TABLE 1

| | Temp. of Preheating HR (° C.) | Temp. of Take-up Roll (° C.) | Drawing Length (cm) | Yarn Temp. (° C.) | Draw Ratio | No. of Fuzzes | Yarn Breakage |
|---|---|---|---|---|---|---|---|
| Ex. 1 | 180 | 180 | 3 | 180-170 | 2.9 | A | A |
| Ex. 2 | 180 | 180 | 10 | 180-153 | 2.8 | A | A |
| Ex. 3 | 180 | 180 | 16 | 180-143 | 2.7 | A | A |
| Ex. 4 | 180 | 180 | 20 | 180-137 | 2.5 | A | A |
| Ex. 5 | 200 | 180 | 3 | 200-187 | 3.1 | A | A |
| Ex. 6 | 200 | 200 | 3 | 200-187 | 3.1 | B | B |
| Ex. 7 | 170 | 170 | 3 | 170-160 | 2.7 | B | A |
| Ex. 8 | 242 | 175 | 7 | 242-225 | 3.5 | B | B |
| Ex. 9 | 200 | 25 | 3 | 200-187 | 2.9 | A | A |
| Comp. Ex. 1 | 180 | 180 | 30 | 200-128 | 2.4 | — | — |
| Comp. Ex. 2 | 180 | 180 | 80 | 180-95 | 2.3 | — | — |
| Comp. Ex. 3 | 200 | 200 | 80 | 200-110 | 2.5 | — | — |

Reference Examples 7 to 10

Drawing was performed in the same manner as in Example 1 (the yarn temperature was 180 to 170° C. and the drawing length was 3 cm), except that the speed of the preheating HR was set to 12 m/min and 30 m/min (Reference Examples 9 and 10). A possible draw ratio was 3.6 times (Reference Example 9) in the case where the speed of the preheating HR was 12 m/min (at a yarn temperature of 180 to 167° C.), while it was 3.1 times (Reference Example 10) in the case where the speed of the preheating HR was 30 m/min (at a yarn temperature of 180 to 168° C.). Drawing was performed in the same manner as in Comparative Example 2 (the yarn temperature was 180 to 92° C. and the drawing length was 80 cm), except that the speed of the preheating HR was set to 12 m/min and 30 m/min (Reference Examples 7 and 8). A possible draw ratio was 3.6 times (Reference Example 7) in the case where the speed of the preheating HR was 12 m/min (at a yarn temperature of 180 to 25° C.), while it was 3.1 times (Reference Example 8) in the case where the speed of the preheating HR was 30 m/min (at a yarn temperature of 180 to 25° C.). Further, drawing was performed in the same manner as in Example 1 (the yarn temperature was 180 to 170° C. and the drawing length was 3 cm), except that the speed of the preheating HR was set to 12 m/min and 30 m/min (Reference Examples 9 and 10). A possible draw ratio was 3.6 times (Reference Example 9) in the case where the speed of the preheating HR was 12 m/min (at a yarn temperature of 180 to 167° C.), while it was 3.1 times (Reference Example 10) in the case where the speed of the preheating HR was 30 m/min (at a yarn temperature of 180 to 168° C.). From these results, the effect of improving the draw ratio by shortening the drawing length was not observed.

Examples 10 to 13

Figure 6:
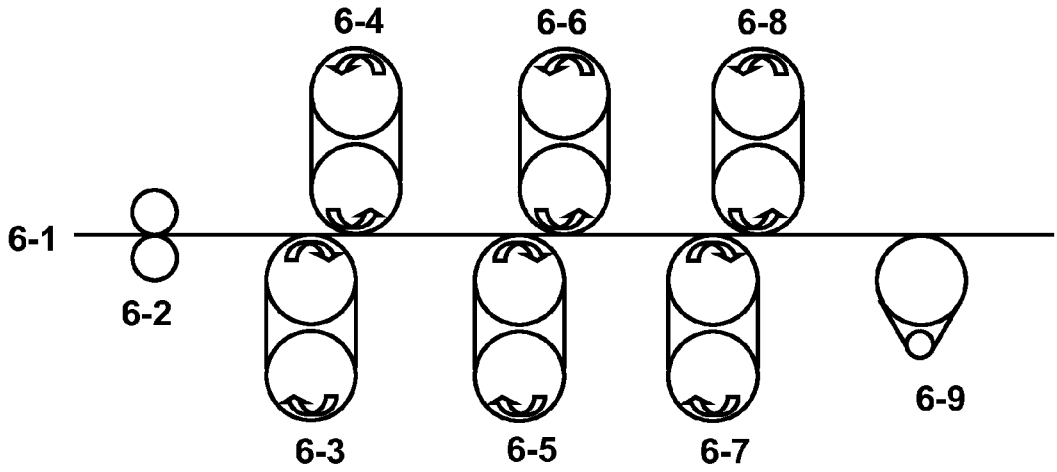
FIG. 6 is a drawing showing an example of a drawing device used in our methods.

The dry yarn produced in Reference Example 1 was fed intact into the drawing device shown in FIG. 6, and hot drawing was then performed. This drawing device (FIG. 6) combines 6 sets of Nelson type HRs, each set having two HRs in pair which rotate at the same surface speed. An undrawn yarn 6-1 was supplied through unheated feed rolls 6-2, and subjected to first-stage drawing between a first HR 6-3 and a second HR 6-4, second-stage drawing between the second HR 6-4 and a third HR 6-5, third-stage drawing between the third HR 6-5 and a fourth HR 6-6, fourth-stage drawing between the fourth HR 6-6 and a fifth HR 6-7, and fifth-stage drawing between the fifth HR 6-7 and a sixth HR 6-8. The drawn yarn was then taken up through an unheated cold roll 6-9. The drawing length each at the first-stage drawing, the third-stage drawing, and the fifth-stage drawing was set to 10 cm (the lower limit of the yarn temperature was 156° C. or higher, specific drawing zone), while the drawing length each at the second-stage drawing and the fourth-stage drawing was set to 100 cm (cooled to a lower limit of the yarn temperature of 25° C.). The first HR 6-3 and the second HR 6-4 rotated in a reverse direction to each other, and arranged in opposed relation to each other obliquely in the up and down direction. The same applies to the relationship between the third HR 6-5 and the fourth HR 6-6, and the relationship between the fifth HR 6-7 and the sixth HR 6-8. Further, the device was designed such that the second HR 6-4, the fourth HR 6-6, and the sixth HR 6-8 were movable in the up and down direction so that the distance between the HRs could be extended at the time of threading and then automatically narrowed after completion of the threading. In addition, the device incorporated a control such that the roll surface speed rates between HRs were all 1.05 times in the state of drawing at an extremely low draw ratio at the time of threading and each HR had a predetermined surface speed after the second HR 6-4, the fourth HR 6-6, and the sixth HR 6-8 were moved to their predetermined positions after completion of threading. This achieved a shorter drawing length without spoiling threadability. Each HR had a diameter of 40 cm and a mirror finished surface, and the yarn was taken up six turns around each HR.

High-speed drawing was performed in which the surface speed of the first HR 6-3 was set to 140 m/min and the temperature of each Nelson HR and the draw ratio at each stage were changed as shown in Table 2. In Example 10, spinning at a take up speed of 830 m/min was possible by five-stage drawing. In Example 11, four-stage drawing was performed in which the drawn yarn was taken up through the cold roll 6-9 without being passed through the sixth HR 6-8, and spinning at a take up speed of 688 m/min was possible. In Example 12, three-stage drawing was performed in which the drawn yarn was taken up through the cold roll 6-9 without being passed through the fifth HR 6-7 and the sixth HR 6-8, and spinning at a take up speed of 706 m/min was possible. At this time, the temperature of the second HR 6-4 was high in some degree so that fuzz and yarn breakage were increased slightly more than in Example 11. In Example 13, five-stage drawing was performed while pairs (in the specific drawing zone) of first HR 6-3/second HR 6-4, third HR 6-5/fourth HR 6-6, and fifth HR 6-7/sixth HR 6-8 were covered with an insulation box provided with a heater after threading so that spinning at a take up speed of 996 m/min was possible. At this time, the ambient temperature in the insulation box was set to 180° C. (in Example 13, the lower limit of the yarn temperature was 180° C.). The specific drawing zone was further covered with an insulation box to suppress cooling of the yarn, thereby enabling further improvement of the draw ratio.

TABLE 2

| | Temp. of HR (° C.) | | | | | | Draw Ratio | | | | | Take Up | | |
|---|---|---|---|---|---|---|---|---|---|---|---|---|---|---|
| | 1st | 2nd | 3rd | 4th | 5th | 6th | 1st Stage | 2nd Stage | 3rd Stage | 4th Stage | 5th Stage | Speed (m/min) | No. of Fuzzes | Yarn Breakage |
| Ex. 10 | 200 | 180 | 180 | 180 | 180 | 180 | 2.9 | 1.1 | 1.3 | 1.1 | 1.3 | 830 | A | A |
| Ex. 11 | 200 | 180 | 190 | 180 | 180 | — | 2.9 | 1.1 | 1.4 | 1.1 | — | 688 | A | A |
| Ex. 12 | 200 | 190 | 190 | 175 | — | — | 3.0 | 1.2 | 1.4 | — | — | 706 | B | B |
| Ex. 13 | 200 | 180 | 180 | 180 | 180 | 180 | 3.0 | 1.1 | 1.4 | 1.1 | 1.4 | 996 | A | A |

Examples 14 and 15

Drawing was performed in the same manner as in Example 10 except that the undrawn yarn to be supplied was changed to the dry yarn produced in Reference Example 2 or 3, and that the surface speed of each HR was changed to obtain the draw ratio shown in Table 3. In Example 14, the lower limits of the yarn temperature at the first-stage drawing, the third-stage drawing, and the fifth-stage drawing were 153° C. or higher (specific drawing zone), and the lower limits of the yarn temperature at the second-stage drawing and the fourth-stage drawing were 25° C. In Example 15, the lower limits of the yarn temperature at the first-stage drawing, the third-stage drawing, and the fifth-stage drawing were 150° C. or higher (specific drawing zone), and the lower limits of the yarn temperature at the second-stage drawing and the fourth-stage drawing were 25° C. The results are shown in Table 3 in contrast to Example 10. The z average molecular weight and the degree of polydispersity of PAN used were lower in Examples 14 and 15 than in Example 10 so that the spinning speed of the dry yarn decreased. As a result, the take-up speed after the drawing were also lower than in Example 10.

TABLE 3

| | Characteristics of Dry Yarn | | | | Draw Ratio | | | | | Take Up | | |
|---|---|---|---|---|---|---|---|---|---|---|---|---|
| | Ref. Ex. For Production | Mz | Degree of Polydispersity | 1st HR Speed (m/min) | 1st Stage | 2nd Stage | 3rd Stage | 4th Stage | 5th Stage | Speed (m/min) | No. of Fuzzes | Yarn Breakage |
| Ex. 10 | 1 | 2,740,000 | 5.7 | 140 | 2.9 | 1.1 | 1.3 | 1.1 | 1.3 | 830 | A | A |
| Ex. 14 | 2 | 920,000 | 2.7 | 100 | 2.8 | 1.1 | 1.3 | 1.1 | 1.3 | 573 | A | A |
| Ex. 15 | 3 | 720,000 | 1.8 | 50 | 2.7 | 1.1 | 1.2 | 1.1 | 1.2 | 235 | A | A |

Examples 16 to 18

Figure 7:
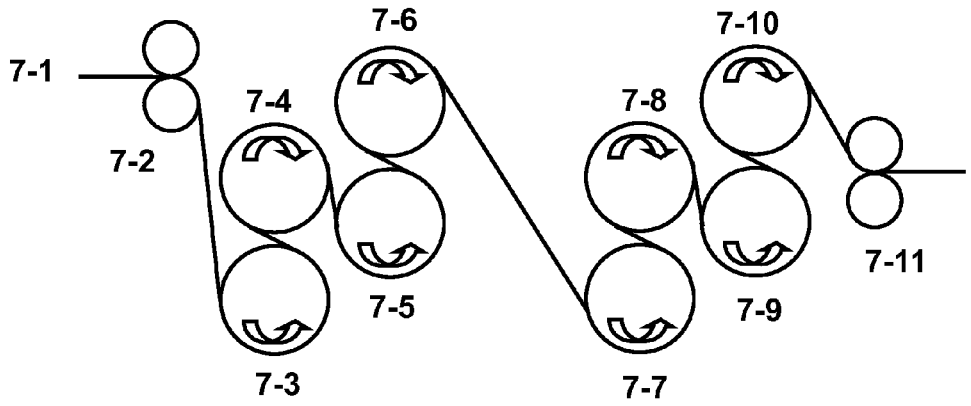
FIG. 7 is a drawing showing an example of a drawing device used in our methods.

The dry yarn produced in Reference Example 1 was fed intact into the drawing device shown in FIG. 7, and hot drawing was then performed. An undrawn yarn 7-1 was supplied through unheated feed rolls 7-2, and the yarn was passed through 8 HRs (7-3 to 10) each on one side, and the drawn yarn was then taken up through an unheated cold roll (7-11). Each HR had a diameter of 50 cm with a mirror finished surface, and the contact distance between each HR and the yarn was 50% or more of the HR peripheral length. Then, drawing was performed between each HRs, and each of the drawing length between the first HR 7-3 and the second HR 7-4 (first stage), between the second HR 7-4 and the third HR 7-5 (second stage), between the third HR 7-5 and the fourth HR 7-6 (third stage), between the fifth HR 7-7 and the sixth HR 7-8 (fifth stage), between the sixth HR 7-8 and the seventh HR 7-9 (sixth stage), and between the seventh HR 7-9 and the eighth HR 7-10 (seventh stage) was set to 10 cm. The drawing length between the fourth HR 7-6 and the fifth HR 7-7 (fourth stage) was set to 2 m. In addition, the device incorporated a control such that the roll surface speed rates between HRs were all 1.05 times in the state of drawing at an extremely low draw ratio at the time of threading and each HR had a predetermined surface speed after completion of threading.

High-speed drawing was performed in which the surface speed of the first HR 7-3 was set to 140 m/min and the temperature of each HR and the draw ratio at each stage were changed as shown in Tables 4 and 5. The temperatures of the second HR 7-4 and of the third HR 7-5 were high in some degree in Example 17 (the lower limit of the yarn temperatures during the first- to third-stage drawing and the fifth- to seventh-stage drawing was 153° C.) so that fuzz and yarn breakage were increased slightly more than in Example 16 (the lower limit of the yarn temperatures during the first- to third-stage drawing and the fifth- to seventh-stage drawing was 153° C.). In Example 18, after threading, the feed roll 6 to the fourth HR 7-6 were grouped as 1 set while the fifth HR 7-7 to the cold roll 7-11 were grouped as 1 set. Then, these sets were covered with an insulation box provided with a heater to perform drawing, and spinning at a take up speed of 1022 m/min was possible. At this time, the ambient temperature in the insulation box was set to 180° C. (the lower limit of the yarn temperature was 180° C.). The specific drawing zone was covered with an insulation box to suppress cooling of the yarn, thereby enabling further improvement of the draw ratio.

TABLE 4

| | Temp. of HR (° C.) | | | | | | | |
|---|---|---|---|---|---|---|---|---|
| | 1st | 2nd | 3rd | 4th | 5th | 6th | 7th | 8th |
| Ex. 16 | 200 | 180 | 180 | 180 | 180 | 180 | 180 | 180 |
| Ex. 17 | 220 | 190 | 190 | 180 | 180 | 180 | 180 | 180 |
| Ex. 18 | 200 | 180 | 180 | 180 | 180 | 180 | 180 | 180 |

TABLE 5

| | Draw Ratio | | | | | | | Take Up | | |
|---|---|---|---|---|---|---|---|---|---|---|
| | 1st Stage | 2nd Stage | 3rd Stage | 4th Stage | 5th Stage | 6th Stage | 7th Stage | Speed (m/min) | Fuzz | Yarn Breakage |
| Ex. 16 | 2.3 | 1.2 | 1.2 | 1.0 | 1.1 | 1.1 | 1.1 | 617 | A | A |
| Ex. 17 | 2.6 | 1.3 | 1.2 | 1.0 | 1.1 | 1.1 | 1.1 | 756 | B | B |
| Ex. 18 | 2.5 | 1.3 | 1.3 | 1.0 | 1.2 | 1.2 | 1.2 | 1022 | A | A |

Comparative Example 4

The dry yarn produced in Reference Example 1 was taken up once and then again subjected to drawing as follows. A 180° C. hot pin (ϕ80 mm, satin-finished surface) was placed between the preheating HR and the take-up roll, a filament was wound around the hot pin twice and then subjected to drawing. Then, the oil agent for fibers was stuck onto the hot pin, resulting in frequent occurrence of fuzz and yarn breakage. Yarn breakage increased particularly in 2 hours after the start of drawing, and drawing became impossible after 4 hours. At this time, the preheating HR had a temperature of 180° C. and a surface speed of 100 m/min, and the take-up roll had a temperature of 180° C. and a surface speed of 230 m/min.

Example 19

The PAN fiber obtained in Example 10 was treated for oxidization for 90 minutes in the air having a temperature distribution of 240 to 260° C. while being applied a tension at a draw ratio of 1.0, to thereby obtain a oxidized fiber. Subsequently, the obtained oxidized fiber was preliminarily carbonized in a nitrogen atmosphere having a temperature distribution of 300 to 700° C. while being drawn at a draw ratio of 1.0, to thereby obtain a preliminarily carbonized fiber. Further, the obtained preliminarily carbonized fiber was treated for carbonization in a nitrogen atmosphere at a maximum temperature of 1300° C. while being applied a tension at a draw ratio of 0.95, to thereby obtain a carbon fiber. The obtained carbon fiber exhibited good mechanical properties with a strand strength of 5.3 GPa and a strand modulus of 240 GPa.

Example 20

A carbon fiber was obtained in the same manner as in Example 19 except that the draw ratio was set to 0.96 and the stress was set to 8.0 mN/dtex in the carbonization treatment. Therefore, the carbon fiber exhibiting good mechanical properties with a strand strength of 5.5 GPa and a strand modulus of 250 GPa was obtained.

Example 21

The carbon fiber obtained in Example 20 was further treated for a second stage of carbonization under a nitrogen atmosphere at a maximum temperature of 1500° C. with a stress of 8.0 mN/dtex. The obtained carbon fiber had a strand strength of 5.8 GPa and a strand modulus of 270 GPa.

Example 22

In Example 21, the second stage of carbonization was performed in a nitrogen atmosphere at a maximum temperature of 1950° C., and a third stage of carbonization was further performed at a draw ratio of 1.01 in a nitrogen atmosphere at a maximum temperature of 2050° C. The obtained carbon fiber had a strand strength of 5.0 GPa and a strand modulus of 320 GPa.

Example 23

Using the PAN fiber obtained in Example 14, an oxidization treatment, a preliminary carbonization treatment, and a carbonization treatment were performed in the same manner as in Example 19. The mechanical properties of the obtained carbon fiber were good with a strand strength of 5.0 GPa and a strand modulus of 240 GPa.

Example 24

Using the PAN fiber obtained in Example 15, an oxidization treatment, a preliminary carbonization treatment, and a carbonization treatment were performed in the same manner as in Example 19. The mechanical properties of the obtained carbon fiber were good with a strand strength of 5.1 GPa and a strand modulus of 240 GPa.

Reference Example 11

A copolymerized PAN fiber having a single fiber fineness of 1 dtex was obtained in the same manner as in Example 10 except that copolymerized PAN used for clothing, which is composed of 94% by mass of an AN-derived component, 5% by mass of a methyl acrylate-derived component, and 1% by mass of a sodium methallylsulfonate-derived component described in Japanese Patent Laid-open Publication No. 2007-126794 was used. The obtained copolymerized PAN fiber was treated for oxidization, preliminary carbonization, and carbonization in the same manner as in Example 19. The mechanical properties of the obtained carbon fiber included a strand strength of 3.8 GPa and a strand modulus of 150 GPa.

Example 25

The dry yarn produced in Reference Example 1 was fed intact into the drawing device shown in FIG. 5, and hot drawing was then performed. This drawing device combines 4 sets of Nelson type HRs, each set having two HRs in pair which rotate at the same surface speed. An undrawn yarn 5-1 was supplied through unheated feed rolls 5-2 and subjected to three-stage drawing. The drawn yarn was then taken up through an unheated cold roll 5-7. Each HR was rotated in the same direction and the drawing lengths between HRs were all 50 cm. Further, these 4 sets of HRs were covered with the insulation box 5-8 provided with the heater after threading, and the ambient temperature in the insulation box was set to 160° C. (the lower limit of the yarn temperature was 160° C.). In addition, the drawn yarn was then taken up at 686 m/min while the temperatures of 4 sets of HRs were all 180° C., the surface speed of the first HR which was a preheating HR was 140 m/min, the draw ratio of the first-stage drawing was 2.5 times, and the draw ratios at the second- and third-stages were 1.4 times. The fuzz and yarn breakage were evaluations as A.

Examples 26 to 34 and Comparative Example 5 to 14

The PAN dry yarn of Reference Example 1 was taken up once and then supplied as an undrawn yarn to the device shown in FIG. 3, to thereby perform second drawing again. The surface speed, temperature, HR-HPL distance, and HPL length of a preheating HR 3-3, a HPL 3-4 and a take-up roll 3-6 were changed as shown in Table 6. The HR-HPL distance is a distance from a yarn separation point on the preheating HR 3-3 to a start point of contact between the HPL 3-4 and the yarn. The yarn speed at each point during drawing was measured and the residence time of the yarn on the HPL was estimated in terms of time. Stretchability was evaluated by the critical draw ratio and the results are shown in Table 6. The relationship between the HR-HPL distance and the critical draw ratio each in Examples 26 to 29 and Comparative Examples 5 to 7 and 11 to 13 is plotted in the graph and shown in FIG. 4. The speed in FIG. 4 indicates the surface speed of the preheating HR. It should be noted that in Comparative Examples 5, 10, and 14, normal HR-HR drawing without using the HPL was performed.

When the preheating HR speed was 100 m/min, the effect of improvement in the critical draw ratio was more significant in Examples 26 to 28 in which the HR-HPL distance was 30 cm or less than in Comparative Examples 6 and 7 in which the HR-HPL distance was more than 30 cm so that the effect of improvement in productivity was larger. The comparisons among Examples 29 to 32 show that the longer the HPL length, the larger the effect of improvement in the critical draw ratio. Further, since the preheating HR temperature and the HPL temperature were high in Example 33 and, conversely, those temperatures were low in Example 34, the effect of improvement in the critical draw ratio in these examples was lower than that in Example 26. In Comparative Examples 8 to 14 in which the preheating HR speed was low, the take-up speed became low, failing to improve productivity. In addition, according to the results of Comparative Examples 8 to 14, the use of the HPL can improve the critical draw ratio more than the case of not using the HPL, but further improvement of the critical draw ratio was not observed by shortening the HR-HPL distance. These results show that the effect obtained by shortening the HR-HPL distance is specific to high-speed drawing.

TABLE 6

| | Preheating HR | | | HPL | | | Temp. of | |
|---|---|---|---|---|---|---|---|---|
| | Temp. (° C.) | Surface Speed (m/min) | HR-HPL Distance (cm) | Temp. (° C.) | Length (cm) | Residence Time (sec.) | Take-up HR (° C.) | Critical Draw Ratio |
| Ex. 26 | 180 | 100 | 9 | 180 | 25 | 0.08 | 180 | 4.0 |
| Ex. 27 | 180 | 100 | 20 | 180 | 25 | 0.08 | 180 | 3.9 |
| Ex. 28 | 180 | 100 | 30 | 180 | 25 | 0.08 | 180 | 3.8 |
| Ex. 29 | 180 | 140 | 9 | 180 | 25 | 0.08 | 180 | 3.8 |
| Ex. 30 | 200 | 140 | 9 | 200 | 50 | 0.14 | 180 | 4.1 |
| Ex. 31 | 200 | 140 | 9 | 200 | 90 | 0.24 | 180 | 4.4 |
| Ex. 32 | 200 | 140 | 9 | 200 | 175 | 0.52 | 180 | 5.0 |
| Ex. 33 | 250 | 100 | 9 | 250 | 25 | 0.10 | 205 | 3.6 |
| Ex. 34 | 168 | 100 | 9 | 170 | 25 | 0.06 | 180 | 3.4 |
| Comp. Ex. 5 | 180 | 100 | — | — | — | — | 180 | 2.4 |
| Comp. Ex. 6 | 180 | 100 | 40 | 180 | 25 | 0.08 | 180 | 3.4 |
| Comp. Ex. 7 | 180 | 100 | 50 | 180 | 25 | 0.08 | 180 | 3.4 |
| Comp. Ex. 8 | 180 | 12 | 9 | 180 | 25 | 0.51 | 180 | 5.0 |
| Comp. Ex. 9 | 180 | 12 | 50 | 180 | 25 | — | 180 | 5.2 |
| Comp. Ex. 10 | 180 | 12 | — | — | — | — | 180 | 3.7 |
| Comp. Ex. 11 | 180 | 30 | 9 | 180 | 25 | — | 180 | 4.2 |
| Comp. Ex. 12 | 180 | 30 | 30 | 180 | 25 | — | 180 | 4.2 |
| Comp. Ex. 13 | 180 | 30 | 50 | 180 | 25 | — | 180 | 4.2 |
| Comp. Ex. 14 | 180 | 30 | — | — | — | — | 180 | 3.2 |

Example 35

Figure 8:
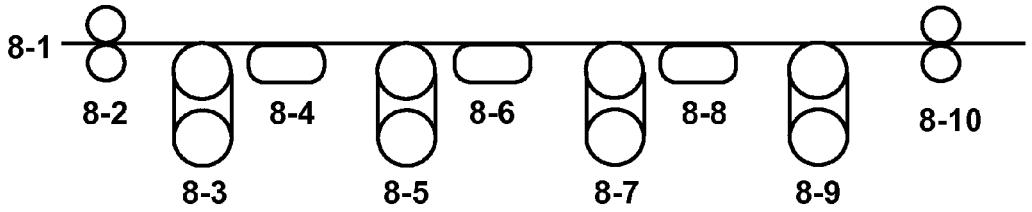
FIG. 8 is a drawing showing an example of a drawing device used in our methods.

The PAN dry yarn of Reference Example 1 was taken up once, and then again subjected to three-stage hot drawing of preheating HR-HPL-HR-HPL-HR-HPL-HR using the device of FIG. 8. At this time, the first to third hot plates had a length of 50 cm, 25 cm, and 25 cm, respectively, and a temperature of 200° C., 180° C., and 180° C., respectively. Each of the HR-HPL distances was 9 cm. The HR-HPL distance is a distance from a yarn separation point on the HR to a start point of contact between the HPL and the yarn. The first to fourth hot rolls each had a temperature of 200° C., 180° C., 180° C., and 180° C. The surface speed of the first hot roll 8-3 was 140 m/min. Further, the draw ratios between the first hot roll 8-3 and the second hot roll 8-5 (first-stage drawing), between the second hot roll 8-5 and the third hot roll 8-7 (second-stage drawing), and between the third hot roll 8-7 and the fourth hot roll 8-9 (third-stage drawing) were 3.6 times, 1.3 times, and 1.3 times, respectively. The PAN dry yarn was taken up at a take-up speed of 852 m/min. When the taken-up yarn was switched, each HPL was replaced to prevent soils from depositing on the HPL. Thus, both improvement in productivity and suppression of fuzz and yarn breakage were achieved.

TABLE 7

| | Draw Ratio | | | | Take Up | | |
|---|---|---|---|---|---|---|---|
| | 1st Stage | 2nd Stage | 3rd Stage | 1st HR Speed (m/min) | Speed (m/min) | Fuzz | Yarn Breakage |
| Ex. 35 | 3.6 | 1.3 | 1.3 | 140 | 852 | A | A |
| Ex. 36 | 4.0 | 1.4 | 1.4 | 100 | 784 | A | A |
| Ex. 37 | 3.1 | 1.15 | 1.15 | 200 | 820 | A | A |

Examples 36 and 37

Drawing was performed in the same manner as in Example 35 except that the surface speed and the draw ratio of the first hot roll 8-3 were changed as shown in Table 7. These changes could achieve both improvement in productivity and suppression of fuzz and yarn breakage.

Examples 38 and 39 and Reference Example 12

Hot drawing was performed in the same manner as in Example 35 except that the dry yarn produced in each of Reference Examples 1 to 3 was led intact into the drawing device shown in FIG. 8, and the surface speed and the draw ratio of the first hot roll 8-3 were changed as shown in Table 8. Thus, it was found that the larger the degree of polydispersity and the z-average molecular weight of the PAN polymer were, the higher the take-up speed can be made, which is advantageous in improving productivity.

TABLE 8

| | | 1st HR Speed | Draw Ratio | | | Take Up Speed | | Yarn |
|---|---|---|---|---|---|---|---|---|
| | Dry Yarn | (m/min) | 1st Stage | 2nd Stage | 3rd Stage | (m/min) | Fuzz | Breakage |
| Ex. 38 | Ref. Ex. 1 | 140 | 3.6 | 1.3 | 1.3 | 852 | A | A |
| Ex. 39 | Ref. Ex. 2 | 100 | 3.5 | 1.3 | 1.3 | 592 | A | A |
| Ref. Ex. 12 | Ref. Ex. 3 | 50 | 3.5 | 1.3 | 1.3 | 296 | A | A |

Example 40

The PAN fiber obtained in Example 38 was treated for oxidization for 90 minutes in the air having a temperature distribution of 240 to 260° C. while being applied a tension at a draw ratio of 1.0, to thereby obtain a oxidized fiber. Subsequently, the obtained oxidized fiber was preliminarily carbonized in a nitrogen atmosphere having a temperature distribution of 300 to 700° C. while being drawn at a draw ratio of 1.0, to thereby obtain a preliminarily carbonized fiber. Further, the obtained preliminarily carbonized fiber was treated for carbonization in a nitrogen atmosphere at a maximum temperature of 1300° C. while being applied a tension at a draw ratio of 0.95, to thereby obtain a carbon fiber. The obtained carbon fiber exhibited good mechanical properties with a strand strength of 5.3 GPa and a strand modulus of 240 GPa.

Example 41

In the carbonization treatment, a carbon fiber was obtained in the same manner as in Example 40 except that the draw ratio was set to 0.96, and the stress was set to 8.0 mN/dtex. Therefore, the carbon fiber exhibiting good mechanical properties with a strand strength of 5.5 GPa and a strand modulus of 250 GPa was obtained.

Example 42

The carbon fiber obtained in Example 41 was further subjected to a second stage of a carbonization treatment under a nitrogen atmosphere having a maximum temperature of 1500° C. with a stress of 8.0 mN/dtex. The obtained carbon fiber had a strand strength of 5.8 GPa and a strand modulus of 270 GPa.

Example 43

In Example 42, the second stage of a carbonization treatment was performed in a nitrogen atmosphere having a maximum temperature of 1950° C., and a third stage of a carbonization treatment was further performed in a nitrogen atmosphere having a maximum temperature of 2050° C. with a draw ratio of 1.01. The obtained carbon fiber had a strand strength of 5.0 GPa and a strand modulus of 320 GPa.

Example 44

Using the PAN fiber obtained in Example 39, an oxidization treatment, a preliminary carbonization treatment, and a carbonization treatment were performed in the same manner as in Example 41. The mechanical properties of the obtained carbon fiber were good with a strand strength of 5.0 GPa and a strand modulus of 240 GPa.

Example 45

Using the PAN fiber obtained in Reference Example 12, an oxidization treatment, a preliminary carbonization treatment, and a carbonization treatment were performed in the same manner as in Example 40. The mechanical properties of the obtained carbon fiber were good with a strand strength of 5.1 GPa and a strand modulus of 240 GPa.

Reference Example 13

Copolymerized PAN used for clothing, which is composed of 94% by mass of an AN-derived component, 5% by mass of a methyl acrylate-derived component, and 1% by mass of a sodium methallylsulfonate-derived component described in Japanese Patent Laid-open Publication No. 2007-126794, was spun and drawn in the same manner as in Example 35 to obtain a copolymerized PAN fiber having a single fiber fineness of 1 dtex. The obtained copolymerized PAN fiber was subjected to an oxidization treatment, a preliminary carbonization treatment, and a carbonization treatment in the same manner as in Example 40. The mechanical properties of the obtained carbon fiber included a strand strength of 3.8 GPa and a strand modulus of 150 GPa.

Examples 46 to 51

The PAN dry yarn of Reference Example 4 was taken up once and then supplied as an undrawn yarn to the device shown in FIG. 2, to thereby perform second drawing again.

The same procedures as in Example 1 were performed except that the draw ratio was change to those shown in Table 9. The results of Examples 46 to 51 show that a lower orientation degree is preferable from the viewpoint of achieving both the draw ratio and the suppression of fuzz and yarn breakage.

TABLE 9

| | Dry Yarn | Draw Ratio | Fuzz | Yarn Breakage |
|---|---|---|---|---|
| Ex. 1 | Ref. Ex. 1 | 2.9 | A | A |
| Ex. 46 | Ref. Ex. 4-1 | 3.5 | A | A |
| Ex. 47 | Ref. Ex. 4-2 | 3.4 | A | A |
| Ex. 48 | Ref. Ex. 4-3 | 4.1 | A | A |
| Ex. 49 | Ref. Ex. 4-4 | 2.9 | A | B |
| Ex. 50 | Ref. Ex. 4-5 | 3.6 | A | A |
| Ex. 51 | Ref. Ex. 4-6 | 2.5 | B | B |

Examples 52 to 57

The PAN dry yarn of Reference Example 4 was taken up once and then supplied as an undrawn yarn to the device shown in FIG. 3, to thereby perform second drawing again. The same procedures as in Example 26 were performed except that the draw ratio was changed to those shown in Table 10. The results of Examples 52 to 57 show that a lower orientation degree is preferable from the viewpoint of achieving both the draw ratio and the suppression of fuzz and yarn breakage.

TABLE 10

| | Dry Yarn | Draw Ratio | Fuzz | Yarn Breakage |
|---|---|---|---|---|
| Ex. 26 | Ref. Ex. 1 | 4.0 | A | A |
| Ex. 52 | Ref. Ex. 4-1 | 4.6 | A | A |
| Ex. 53 | Ref. Ex. 4-2 | 4.5 | A | A |
| Ex. 54 | Ref. Ex. 4-3 | 5.0 | A | A |
| Ex. 55 | Ref. Ex. 4-4 | 3.8 | A | B |
| Ex. 56 | Ref. Ex. 4-5 | 4.6 | A | A |
| Ex. 57 | Ref. Ex. 4-6 | 3.5 | B | B |

INDUSTRIAL APPLICABILITY

According to our method of manufacturing a PAN fiber, even if hot drawing is used in the second drawing process, a PAN fiber can be obtained without generation of fuzz or yarn breakage and at a sufficient draw ratio. This allows the spinning speed of the PAN fiber to be accelerated so that productivity of the PAN fiber which is a carbon fiber precursor can be improved, which can contribute to reduction in cost of the carbon fiber.

The invention claimed is:

1. A method of manufacturing a polyacrylonitrile fiber comprising a spinning process in which a spinning dope comprising polyacrylonitrile is spun; a first drawing process; a drying process; and a second drawing process in this order, the method comprising, as the second drawing process, any of the following hot drawing processes (a) to (c):

(a) a process of performing, as the second drawing, hot drawing with a plurality of rolls, at least one of which is a hot roll, in the air setting a yarn temperature from a yarn separation point on the hot roll to a first yarn contact point on the subsequent roll to 130° C. or higher, wherein a distance from the yarn separation point on the preheating roll to the first yarn contact point on the subsequent roll is 20 cm or less;

(b) a process of performing, as the second drawing, hot drawing with a plurality of rolls, at least one of which is a hot roll, setting a distance from the yarn separation point on the hot roll to the first yarn contact point on the subsequent roll to 20 cm or less; and (c) a process of performing the second drawing in a hot plate drawing zone where a hot plate is placed between two rolls, one of which is a preheating roll arranged forward of the hot plate drawing zone, while the hot plate is positioned so that a start point of contact between the hot plate and a yarn is at a distance of 30 cm or less from the yarn separation point on the preheating roll, and the surface speed of the preheating roll is set to 100 m/min or more.

2. The method according to claim 1, wherein the polyacrylonitrile fiber subjected to any of the hot drawing processes (a) to (c) has an orientation degree of 60 to 85% obtained by wide angle X-ray diffraction.

3. The method according to claim 1, wherein, in the hot drawing process (a) or (b), the temperature of the preheating roll arranged forward among the plurality of hot rolls is 160° C. or higher.

4. The method according to claim 1, wherein, in the hot drawing process (a) or (b), the surface speed of the preheating HR is 100 m/min or more.

5. The method according to claim 1, wherein the draw ratio in the hot drawing process is 1.5 times or more.

6. The method according to claim 1, wherein a region where any of the hot drawing processes (a) to (c) is performed is enclosed by a heat insulation means capable of heating or keeping a temperature constant.

7. The method according to claim 1, wherein an acrylonitrile monomer-derived component in polyacrylonitrile is 95% by mass or more.

8. The method according to claim 1, wherein polyacrylonitrile has a z-average molecular weight measured by a gel permeation chromatography method of 800,000 to 6,000,000 and a degree of polydispersity of 2.5 to 10.

9. A method of manufacturing a carbon fiber, comprising a process of further subjecting the polyacrylonitrile fiber obtained by the method according to claim 1 to carbonization.

* * * * *